United States Patent [19]

Naya et al.

[11] Patent Number: 4,870,231

[45] **Date of Patent: * Sep. 26, 1989**

[54] CONTACT FOR VACUUM INTERRUPTER

[75] Inventors: Eizo Naya; Mitsuhiro Okumura, both of Amagasaki, Japan

[73] Assignee: Mitsubishi Denki Kabushiki Kaisha, Tokyo, Japan

[ * ] Notice: The portion of the term of this patent subsequent to Dec. 2, 2003 has been disclaimed.

[21] Appl. No.: 80,260

[22] Filed: Jul. 27, 1987

Related U.S. Application Data

[63] Continuation-in-part of Ser. No. 807,695, Dec. 11, 1985, abandoned.

[30] Foreign Application Priority Data

Dec. 13, 1984 [JP] Japan ..... 59-263192
Jan. 10, 1985 [JP] Japan ..... 60-2689

[51] Int. Cl.[4] ..... H01H 1/02
[52] U.S. Cl. ..... 200/266
[58] Field of Search ..... 200/262, 264, 265, 266, 200/144 B

[56] References Cited

U.S. PATENT DOCUMENTS

| | | | |
|---|---|---|---|
| 4,323,590 | 4/1982 | Lipperts | 200/144 B |
| 4,419,551 | 12/1983 | Kato | 200/144 B |
| 4,430,124 | 2/1984 | Kato | 75/248 |
| 4,486,631 | 12/1984 | Naya et al. | 200/266 |
| 4,517,033 | 5/1985 | Okumura et al. | 200/266 |
| 4,575,451 | 3/1986 | Naya et al. | 200/266 |
| 4,626,282 | 12/1986 | Naya et al. | 200/266 |

FOREIGN PATENT DOCUMENTS

| | | | |
|---|---|---|---|
| 0101024 | 2/1984 | European Pat. Off. | 200/262 |

OTHER PUBLICATIONS

Japanese Language Article No. 10.2.6 at pp. 229–230 in "Funmatsu Yakin Gaku" (Powder Metallurgy), published by the Daily Industrial News.

*Primary Examiner*—Renee S. Luebke
*Attorney, Agent, or Firm*—Lowe, Price, LeBlanc, Becker & Shur

[57] ABSTRACT

A contact for a vacuum interrupter, of a material containing copper (Cu), chromium (Cr), molybdenum (Mo), and either tantalum (Ta) or niobium (Nb), has splendid interrupting ability and breakdown voltage ability.

8 Claims, 18 Drawing Sheets

CONTACT FOR VACUUM INTERRUPTER

This application is a continuation-in-part of application Ser. No. 807,695, filed Dec. 11, 1985 abandoned.

BACKGROUND OF THE INVENTION

1. Field of the Invention

The present invention relates generally to a contact for a vacuum interrupter, and particularly to a contact for a vacuum interrupter which has large current interrupting ability and breakdown voltage ability.

2. Description of the Related Art

Vacuum interrupters have low maintenance, no environmental pollution and splendid current interrupting ability. As a result, they find increasing use and must meet demands for even higher breakdown voltage ability and large current interrupting ability. The performance of the vacuum interrupter is determined in large measure by contact materials in the vacuum container.

Desirable properties in a contact material for vacuum interrupters include a large interrupting capacity, high breakdown voltage, small contact resistance, small separating force of contact, low wearing out of control, small chopping current, good workability and mechanical strength, and the like. In using the conventional practical contact materials, it is actually difficult to satisfy all of the above-mentioned characteristics.

For instance, the copper(Cu)-tungsten(W) contact material shown in published unexamined patent application No. Sho. 55-78429 has very good interrupting ability, so that it is used mostly for purposes of load switch and contactor, or the like. However, copper has come limitations in its ability to interrupt large currents.

On the other hand, the copper(Cu)-chrome(Cr) alloy shown in published unexamined patent application No. Sho. 54-71375 has excellent interrupting ability, so that it is used more for interrupters, or the like, but it is inferior to the above-mentioned copper(Cu)-tungsten(W) contact material in breakdown voltage ability.

Besides the above mentioned contact materials for vacuum interrupters, some examples of contact materials used in the gas or oil industry are given in literature of "Funmatsu Yakin Gaku" (Powder Metallurgy) published by the Dally Industrial news, Tokyo Japan.

However, contact materials of silver(Ag)-molybdenum(Mo) alloy, of copper(Cu)-molybdenum(Mo) alloy, or the like disclosed in above-mentioned literature, are now rarely used for vacuum interrupters, because when they are used for contact for vacuum interrupters their breakdown voltage abilities are inferior to the above-mentioned copper(Cu)-tungsten(W) contact material, and their current interrupting abilities are inferior to said copper(Cu)-chrome(Cr) contact material.

As mentioned above, conventional contacts for vacuum interrupters have been used, making good use of their own characteristics; but, recently, demands for adaptations thereof to larger current and higher voltage have become more severe, and it has become difficult to satisfy these demands with the conventional contact material. Furthermore, for miniaturization of the vacuum interrupters, a contact material having even better characteristics is required.

OBJECT AND SUMMARY OF THE INVENTION

The purpose of the present invention is to provide an improved contact material high in interrupting ability and breakdown voltage ability.

The present invention is characterized in that in a vacuum interrupter which has a pair of opposing electrodes able to open and close in a vacuum container, the electrode material contains copper(Cu), Chromiun(Cr), and molybdenum(Mo) and one further member selected from a group consisting of tantalum(Ta) and Niobium(Nb).

The contact material of the present invention can be manufactured by the infiltration, sintering or hot-press methods and, in one mode, some or all of the above-mentioned constituent metals may be dispersed in the contact material in the form of individual metals, or alternatively in another mode, at least two or all kinds of the constituent metals may form an alloy or intermetallic compound. In another alternative mode, two or more of the single substance metals, the alloy and the intermetallic compound may coexist with each other in the contact material.

Hereinafter, the words "contact material" are used to include all modes and varieties of the contact materials mentioned above.

DESCRIPTION OF THE PREFERRED EMBODIMENTS

Figure 1:
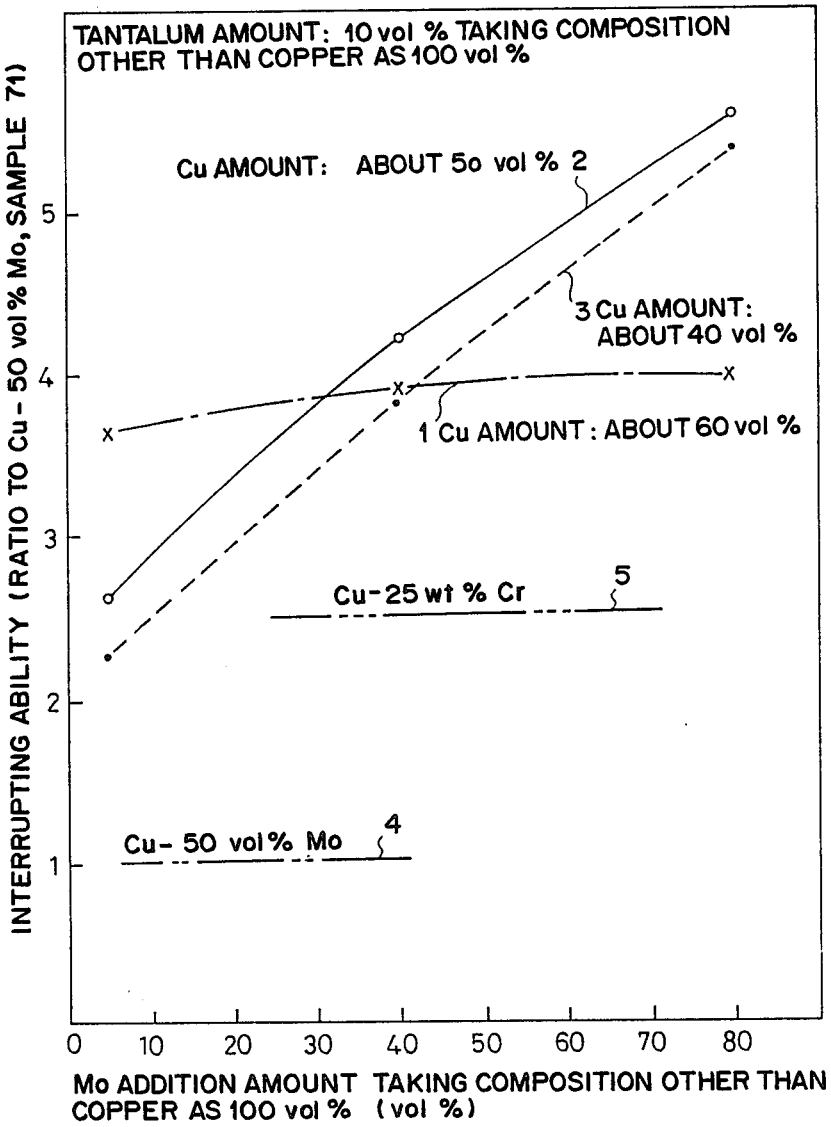
FIG. 1, FIG. 2 and FIG. 3 are graphs which show the interrupting abilities of copper-chromium-molybdenum-tantalum contact materials manufactured by an infiltration method as an embodiment of the present invention.

Following are explanations of the preferred embodiments of the present invention.

First, an explanation is given of the first group of embodiments, wherein the contact material consists of copper, chromium, molybdenum, and tantalum.

The contact materials are made by powder metallurgy techniques, which include three kinds of methods, i.e., infiltration method, sintering method and hot press method.

The first method of manufacturing contact material by the infiltration method is as follows. Chromium(Cr) powder of under 45 μm particle diameter, molybdenum(Mo) powder of 3 μm average particle diameter, tantalum(Ta) powder of under 40 μm particle diameter and copper(Cu) powder under 40 μm particle diameter are weighed respectively in the ratios 34.32:43.28:17.73:14.67. Thereafter, they are mixed for two hours; and next, this mixed powder is charged in a known metal pattern, and is then pressed under a pressure of 1 ton/cm$^2$ to form a green compact.

Next, this green compact is fired for two hours in a vacuum at the temperature of 1000° C. and a presintered green compact is obtained. Thereafter, a lump of oxygen-free copper is put on the presintering green compact, and kept there for one hour in a hydrogen atmosphere at a temperature of 1250° C.; hence contact material is obtained by infiltration of oxygen-free copper into the presinterred green compact. Final ratios of components of the above-mentioned contact material are shown as sample 12 in Table 1. Further, contact materials other than sample 12, which are made by the above-mentioned method and respectively have different ratios of components, are also shown in Table 1. For sample 1–10 the target copper amount is 60 volume %, for sample 11–20 the target copper amount is 50 volume %, for sample 21–30 the target copper amount is 40 volume %.

TABLE 1

| Sample | Component (vol %) | Electric conductivity (IACS %) | Remarks |
|---|---|---|---|
| 1 | Cu-40(Cr-5Mo-10Ta) | 51.2 | Target Cu amunt: 60 vol % |
| 2 | Cu-39(Cr-45Mo-10Ta) | 60.0 | |
| 3 | Cu-41(Cr-85Mo-10Ta) | 67.2 | |
| 4 | Cu-42(Cr-5Mo-30Ta) | 56.3 | |
| 5 | Cu-39(Cr-35Mo-30Ta) | 63.8 | |
| 6 | Cu-40(Cr-65Mo-30Ta) | 70.1 | |
| 7 | Cu-40(Cr-5Mo-50Ta) | 59.6 | |
| 8 | Cu-41(C-25Mo-50Ta) | 65.7 | |
| 9 | Cu-39(Cr-45Mo-50Ta) | 70.0 | |
| 10 | Cu-40(Cr-15Mo-70Ta) | 70.5 | |
| 11 | Cu-51(Cr-5Mo-10Ta) | 42.0 | Target Cu amount: 50 Vol |
| 12 | Cu-52(Cr-45Mo-10Ta) | 44.6 | |
| 13 | Cu-50(Cr-85Mo)-10Ta) | 59.8 | |
| 14 | Cu-51(Cr-5Mo-30Ta) | 43.3 | |
| 15 | Cu-49(Cr-35Mo-30Ta) | 48.1 | |
| 16 | Cu-53(Cr-65Mo-30Ta) | 60.5 | |
| 17 | Cu-50(Cr-5Mo-50Ta) | 48.0 | |
| 18 | Cu-51(Cr-25Mo-50Ta) | 50.0 | |
| 19 | Cu-49(Cr-45Mo-50Ta) | 62.1 | |
| 20 | Cu-53(Cr-15Mo-70Ta) | 60.9 | |
| 21 | Cu-61(Cr-5Mo-10Ta) | 38.5 | Target Cu amount: 40 vol % |
| 22 | Cu-62(Cr-45Mo-10Ta) | 41.2 | |
| 23 | Cu-61(Cr-85Mo-10Ta) | 50.6 | |
| 24 | Cu-60(Cr-5Mo-30Ta) | 41.1 | |
| 25 | Cu-61(Cr-35Mo-30Ta) | 46.3 | |
| 26 | Cu-59(Cr-65Mo-30Ta) | 50.6 | |
| 27 | Cu-60(Cr-5Mo-50Ta) | 45.0 | |
| 28 | Cu-57(Cr-25Mo-50Ta) | 48.8 | |
| 29 | Cu-61(Cr-45Mo-50Ta) | 53.1 | |
| 30 | Cu-60(Cr-15Mo-70Ta) | 51.1 | |

The second manufacturing method of producing the contact material, i.e., by sintering, is as follows. Chromium(Cr) powder of under 75 μm in particle diameter, molybdenum(Mo) powder of 3 μm in average particle diameter, tantalum(Ta) powder under 40 μm in particle diameter and copper(Cu) powder under 40 μm in particle diameter are weighed in the ratio of 14.40:18.16:7.44:60.00, and thereafter they are mixed for two hours; next, the mixed powder is charged in a known metal pattern and pressed under a pressure of about 3.3 ton/cm$^2$ to form a green compact.

This green compact is then fired for two hours under a hydrogen atmosphere at a temperature of 1075°–1080° C. (under the melting point of copper). Thus the contact material is obtained. Ratios of components of said contact material are shown as sample 32 in Table 2. Further, contact materials other than sample 32, which are made by the above-mentioned method and respectively have different ratios of components are shown in Table 2. In Table 2, for samples 31–40 the copper amount is 60 volume %, and for samples 41–50 the copper amount is 75 volume %.

TABLE 2

| Sample | Component (vol %) | Electric conductivity (IACS %) |
|---|---|---|
| 31 | Cu-40(Cr-5Mo-10Ta) | 38.3 |
| 32 | Cu-40(Cr-45Mo-10Ta) | 42.0 |
| 33 | Cu-40(Cr-85Mo-10Ta) | 51.1 |
| 34 | Cu-40(Cr-5Mo-30Ta) | 42.2 |
| 35 | Cu-40(Cr-35Mo-30Ta) | 47.8 |
| 36 | Cu-40(Cr-65Mo-30Ta) | 55.0 |
| 37 | Cu-40(Cr-5Mo-50Ta) | 41.9 |
| 38 | Cu-40(Cr-25Mo-50Ta) | 48.1 |
| 39 | Cu-40(Cr-45Mo-50Ta) | 56.3 |
| 40 | Cu-40(Cr-15Mo-70Ta) | 58.8 |
| 41 | Cu-25(Cr-5Mo-10Ta) | 50.4 |
| 42 | Cu-25(Cr-45Mo-10Ta) | 60.3 |
| 43 | Cu-25(Cr-85Mo-10Ta) | 68.8 |
| 44 | Cu-25(Cr-5Mo-30Ta) | 53.3 |
| 45 | Cu-25(Cr-35Mo-30Ta) | 61.6 |
| 46 | Cu-25(Cr-65Mo-30Ta) | 67.3 |
| 47 | Cu-25(Cr-5Mo-50Ta) | 53.5 |
| 48 | Cu-25(Cr-25Mo-50Ta) | 62.2 |
| 49 | Cu-25(Cr-45Mo-50Ta) | 69.2 |
| 50 | Cu-25(Cr-15Mo-70Ta) | 68.1 |

The third manufacturing method of producing contact material, i.e., by the hot-press method, is the same as the above-mentioned sintering method with respect to mixing the metal powder, which is the same as in the above-mentioned example. This mixed powder is charged in a carbon die, and while it is heated for two hours in vacuum, a weight of 200 kg/cm$^2$ is placed on it. Thus a block of the contact material is obtained. This example is shown as sample 32 in Table 3. Further, contact materials other than sample 52, which are made by the above-mentioned method and respectively have different ratios of components are shown in Table 3. In Table 3, for samples 51–60 the copper amount is 60 volume %, and for samples 61–70 the copper amount is 75 volume %.

TABLE 3

| Sample | Component (vol %) | Electric conductivity (IACS %) |
|---|---|---|
| 51 | Cu-40(Cr-5Mo-10Ta) | 45.3 |
| 52 | Cu-40(Cr-45Mo-10Ta) | 49.0 |
| 53 | Cu-40(Cr-85Mo-10Ta) | 60.1 |
| 54 | Cu-40(Cr-5Mo-30Ta) | 47.2 |
| 55 | Cu-40(Cr-35Mo-30Ta) | 51.8 |
| 56 | Cu-40(Cr-65Mo-30Ta) | 62.3 |
| 57 | Cu-40(Cr-5Mo-50Ta) | 49.5 |
| 58 | Cu-40(Cr-25Mo-50Ta) | 52.2 |
| 59 | Cu-40(Cr-45Mo-50Ta) | 63.4 |
| 60 | Cu-40(Cr-15Mo-70Ta) | 66.2 |
| 61 | Cu-25(Cr-5Mo-10Ta) | 62.2 |
| 62 | Cu-25(Cr-45Mo-10Ta) | 64.0 |
| 63 | Cu-25(Cr-85Mo-10Ta) | 70.5 |

TABLE 3-continued

| Sample | Component (vol %) | Electric conductivity (IACS %) |
|---|---|---|
| 64 | Cu-25(Cr-5Mo-30Ta) | 63.3 |
| 65 | Cu-25(Cr-35Mo-0Ta) | 65.8 |
| 66 | Cu-25(Cr-65Mo-30Ta) | 66.1 |
| 67 | Cu-25(Cr-5Mo-50Ta) | 59.8 |
| 68 | Cu-25(Cr-25Mo-50Ta) | 66.9 |
| 69 | Cu-25(Cr-45Mo-50Ta) | 71.1 |
| 70 | Cu-25(Cr-15Mo-70Ta) | 70.2 |

Further, conventional contact materials for comparison with contact materials of the present invention are shown as samples 71–74 in Table 4. In Table 4 the sample 71 is for copper(Cu)-molybdenum(Mo) alloy as a comparative example obtained by an infiltration method, the sample 72 is for copper(Cu)-molybdenum(Mo) alloy obtained by a sintering method, the sample 73 is for copper(Cu)-molybdenum(Mo) alloy obtained by a hot press method and sample 74 is for copper(Cu)-chromium(Cr) alloy obtained by a sintering method.

TABLE 4

| Sample | Component (vol %) | Electric Conductivity (IACS %) | Remarks |
|---|---|---|---|
| 71 | Cu—50 Mo | 60.5 | Comparative example (Infiltrating method) |
| 72 | Cu—25 Mo | 66.9 | Comparative example (Complete powder sintering method) |
| 73 | Cu—25 Mo | 76.1 | Comparative.example (Hot-press method) |
| 74 | Cu—25 wt % Cr | 41.8 | Conventional example (Complete powder sintering method) |

CHARACTERISTICS OF CONTACT MATERIALS, AND EXPERIMENTS

Contact materials manufactured by the above-mentioned methods are machine-worked into electrodes of approximately 20 mm in diameter, and thereafter, the electric conductivity of each is measured. A metal conductivity measurement apparatus (Institut br, Forster GmbH Co. KG SIGMA TEST 2.067) is used for this measurement of electrical conductivity, and measured data are shown in Table 1, 2, 3 and 4. From the above-mentioned data it is found that contact materials in the present invention are equal to, or superior to the conventional copper(Cu)-chromium(Cr) contact material.

Figure 2:
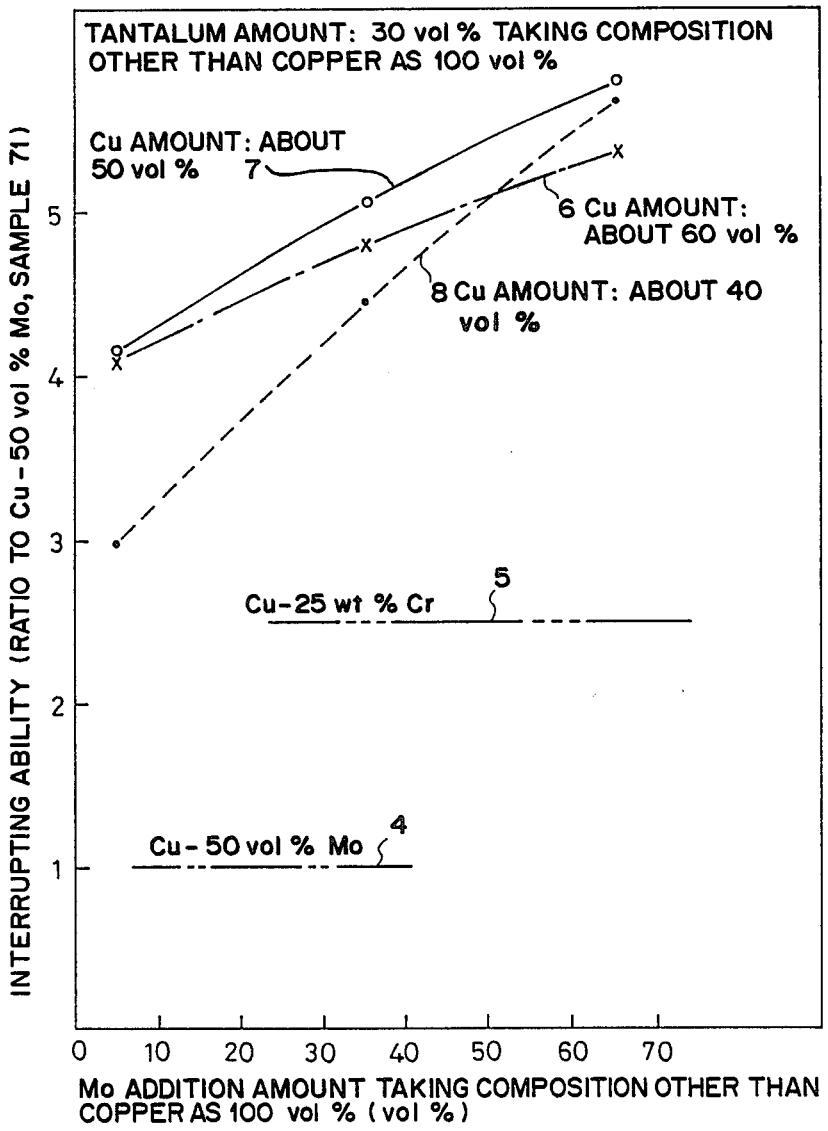
Figure 3:
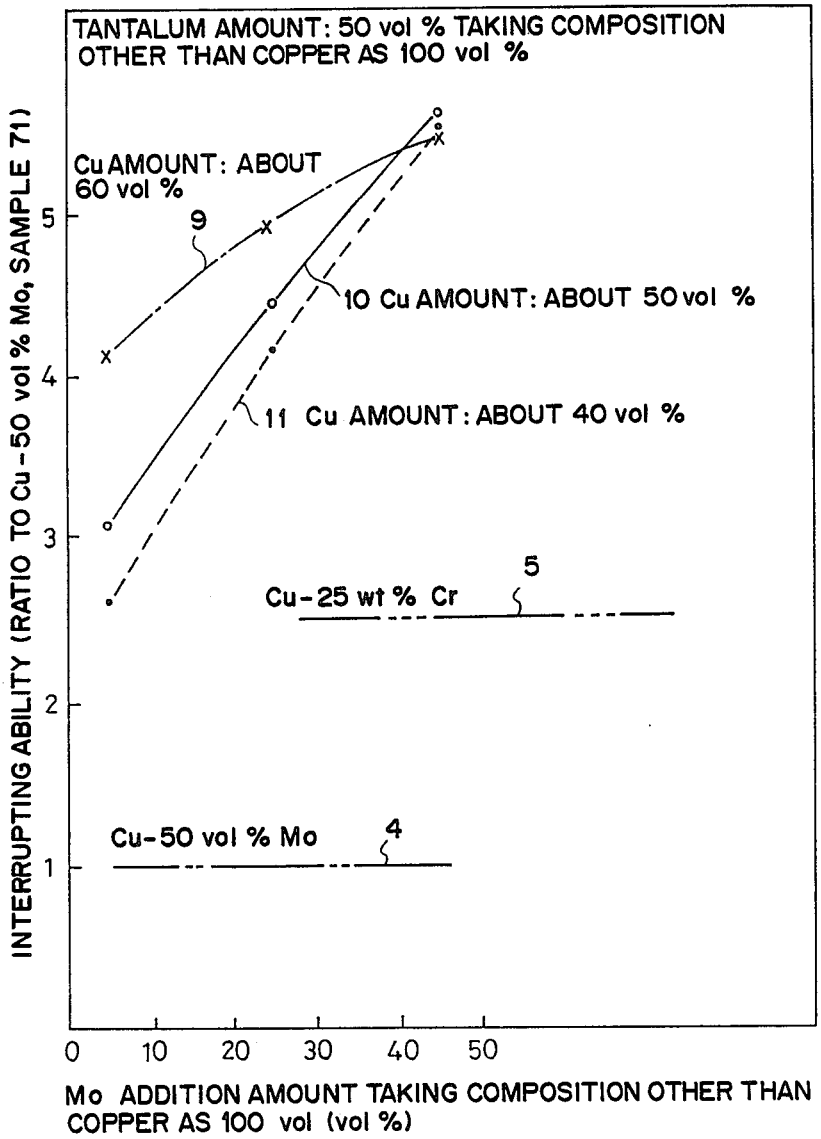

Next, a vacuum interrupter is assembled by using the electrodes thus made and the electrical characteristics thereof are measured. FIG. 1, FIG. 2 and FIG. 3 show the interrupting abilities of contact materials of the present invention in Table 1, by taking the interrupting ability of sample 71 (comparative sample) as 1. Since the contact materials in the present invention consist of four components, abscissas of FIGS. 1–3 show component ratio of molybdenum(Mo) in composition other than copper(Cu) by volume % taking the composition excluding copper as a reference (100 volume %). Ordinates of FIGS. 1–3 show ratio of interrupting abilities of the contact materials of the present invention taking the interrupting ability of copper(Cu)-50 volume % molybdenum(Mo) comparative contact material (sample 71) as 1.

The curves are divided into FIGS. 1–3 depending on the proportions of tantalum(Ta) in compositions excluding copper(Cu). That is, FIG. 1 is for the contact materials of the present invention wherein tantalum(Ta) accounts for 10 volume % of the composition excluding copper(Cu). Curve (1) in FIG. 1 shows the interrupting abilities of contact materials of samples 1–3 in Table 1 of the present invention, wherein copper accounts for 60 volume % and tantalum occupies 10 volume % of the composition other than copper, the composition being about 40 volume % of the contact material. Curve (2) in FIG. 1 shows the interrupting abilities of contact materials of samples 11–13 in Table 1 of the present invention, wherein copper accounts for 50 volume % and tantalum(Ta) occupies 10 volume % of the composition other than copper, the composition being 50 volume % of contact material. Curve (3) in FIG. 1 shows the interrupting abilities of contact materials of samples 21–23 in Table 1 of the present invention, wherein copper accounts for 40 volume % and tantalum occupies 10 volume % of the composition other than copper, the composition being about 60 volume % of contact material. Line 4 in FIG. 1 shows the interrupting ability of the copper(Cu)-molybdenum(Mo) contact material of the comparative sample 71. Line (5) in FIG. 1 shows the interrupting ability of conventional copper(Cu)-chromium(Cr) contact material of sample 74.

FIG. 2 similarly shows the interrupting abilities of the contact materials of the present invention, wherein copper accounts for about 40 volume %, about 50 volume % and about 60 volume %, and tantalum occupies 30 volume % of the composition other than copper, the composition being about 60 volume %, about 50 volume and about 40 volume %, respectively.

FIG. 3 similarly shows the interrupting abilities of contact materials in the present invention, wherein copper accounts for about 40, about 50 and about 60 volume %, and tantalum occupies 50 volume % of the composition other than copper, the composition being about 60 volume %, about 50 volume % and about 40 volume % of contact material, respectively.

From FIGS. 1–3, it is obvious that the contact materials of the present invention have better interrupting abilities than the comparative copper(Cu)-molybdenum(Mo) contact materials, and furthermore, in comparison with the widely used conventional copper(Cu)-chromium(Cr) contact material, the contact materials of the present invention are superior in interrupting ability.

Concerning samples 10, 20 and 30 in Table 1, wherein tantalum occupies 70 volume % of the composition other than copper, experiments were made for cases wherein chromium(Cr) and molybdenum(Mo) were, respectively, present by 15 volume %. Though their interrupting abilities are not shown in the graphs, examples having 60 volume % copper (sample 10), 50 volume % copper (sample 20) and 40 volume % copper (sample 30) have respectively 5.2 times, 4.2 times and 4.0 times as higher interrupting abilities as the comparative copper molybdenum contact material of sample 71. Accordingly, a component range of the contact materials having practical interrupting abilities is one wherein tantalum is 4–42 volume %, molybdenum is 2–51 volume % and chromium is 2–51 volume %. That is, by taking the composition other than copper as 100 volume %, a range of tantalum amount is 10–70 volume %, a range of molybdenum is 5–85 volume % and a range of chromium is 5–85%. Since the ratios of copper amount to total amount of chromium, moluybdenum and tantalum are 40:60, 50:50 or 60:40, respectively, the minimum amount of tantalum in the whole composition of the contact material including the copper becomes 4 volume %

$$\left(10 \times \frac{40}{60 + 40} = 4\right)$$

and the maximum amount becomes 42 volume %

$$\left(70 \times \frac{60}{40 + 60} = 42\right).$$

In a similar manner, the amount of chromium or molybdenum in the whole composition of the contact materials including the copper become 2 (minimum)–51 (maximum) volume %.

Figure 4:
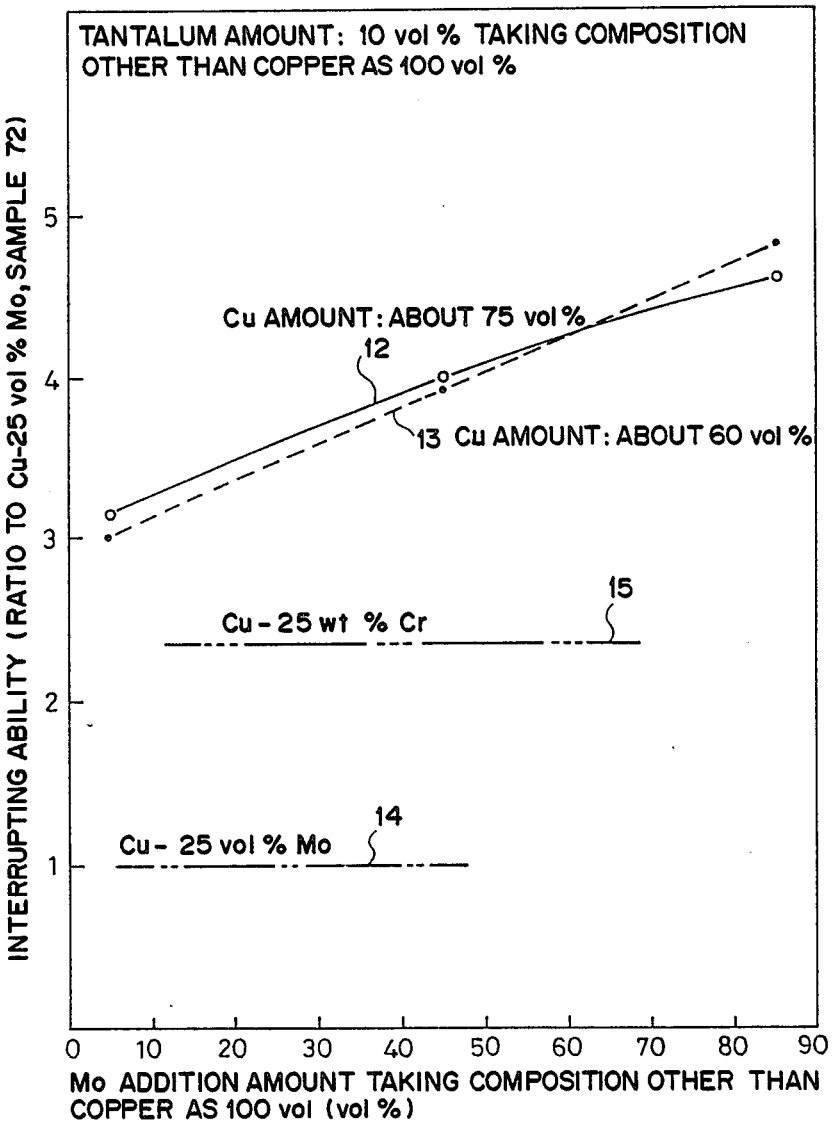
FIG. 4, FIG. 5 and FIG. 6 are graphs which show the interrupting abilities of copper-chromium-molybdenum-tantalum-contact materials manufactured by a sintering method as an embodiment of the present invention.
Figure 5:
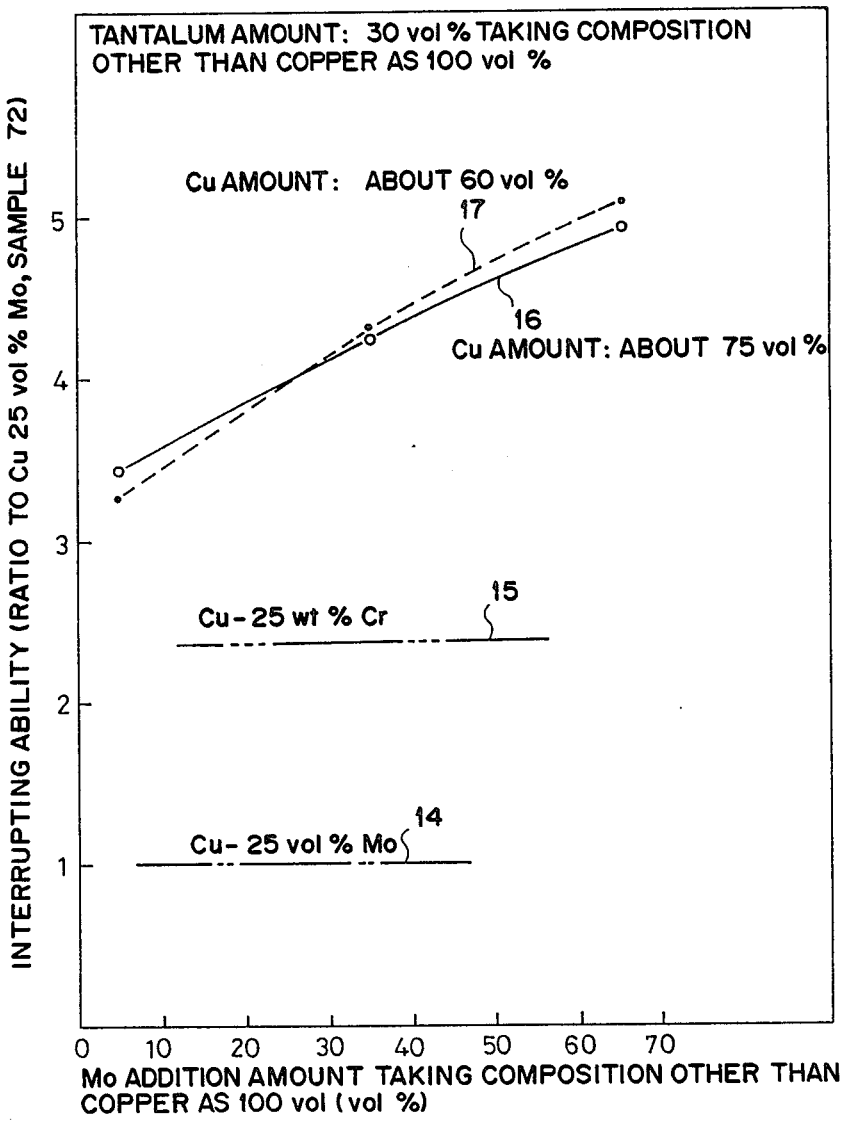
Figure 6:
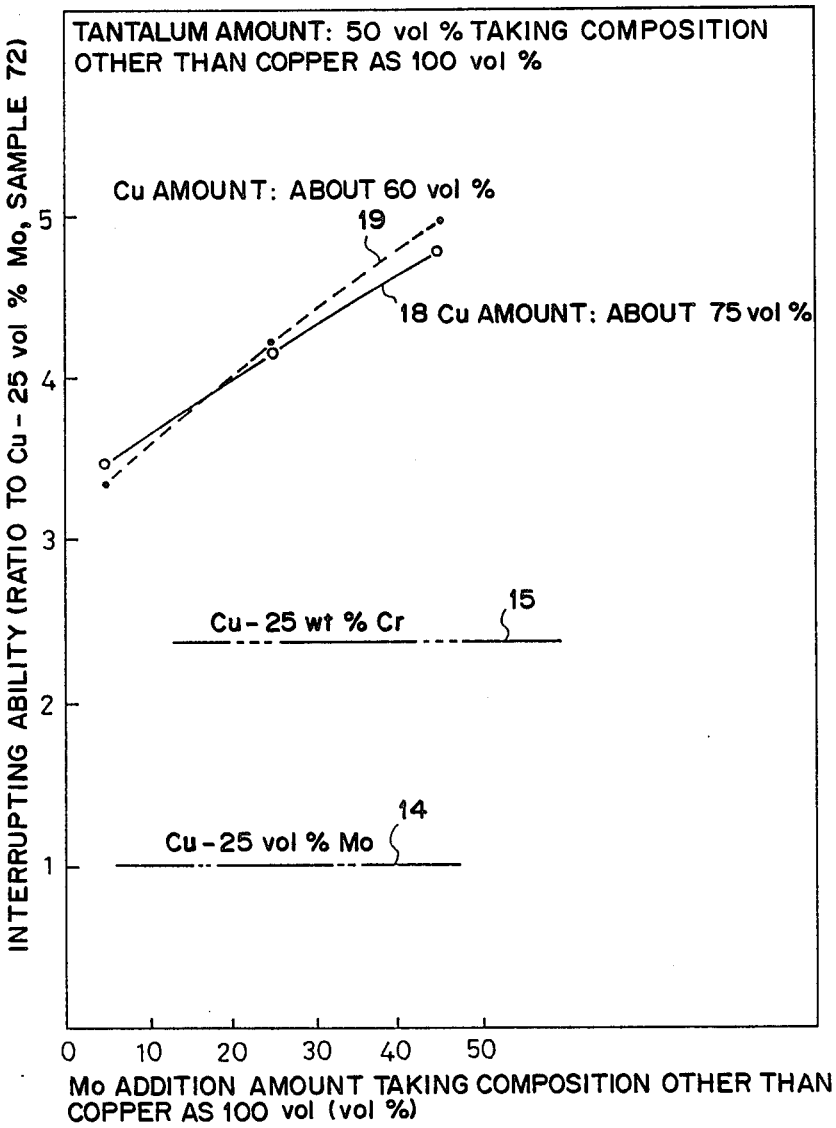

The interrupting abilities of the present invention obtained by the above-described sintering method are shown in FIGS. 4, 5 and 6. Since the contact materials consist of four components, abscissas of FIGS. 4–6 show component ratio of molybdenum(Mo) in composition other than copper by volume % taking the composition excluding the copper as a reference (100 volume %). The ordinates of FIGS. 4–6 show the ratioes of interrupting abilities of the contact materials of the present invention taking the interrupting ability of copper(Cu)-25 volume % molybdenum(Mo) comparative contact material (sample 71) as 1.

The curves are divided into FIGS. 4–6 depending on ratios of tantalum to compositions excluding copper(Cu). That is, FIG. 4 is for the contact materials of the present invention wherein tantalum accounts for 10 volume % of composition excluding copper. Curve (12) in FIG. 4 shows the interrupting abilities of contact materials of samples 41, 42 and 43 of the present invention wherein tantalum occupies 10 volume % of the composition other than copper, the composition being 25 volume % of the contact material. Curve (13) in FIG. 4 shows the interrupting abilities of contact materials of sample 31, 32 and 33 of the present invention, wherein tantalum occupies 10 volume % of the composition other than copper, the composition being 40 volume %. Further, line (14) in FIG. 4 shows the interrupting ability of the copper-molybdenum contact material of the comparative sample 72. Line (15) in FIG. 4 shows the interrupting ability of conventional copper-chromium contact material of sample 74.

FIG. 5 similarly shows the interrupting abilities of the contact materials of the present invention wherein copper accounts for about 75 volume % and 60 volume %, and tantalum occupies 30 volume % of the composition other than copper, the composition being about 25 volume % and 40 volume % of the contact material, respectively.

FIG. 6 similarly shows the interrupting abilities of contact materials wherein copper amount accounts for about 60 and about 75 volume % and tantalum occupies 30 volume % of the composition other than copper, the composition being about 40 volume % and about 25 volume % of contact material, respectively.

From FIGS. 4, 5 and 6, it is obvious that the contact materials of the present invention have better interrupting abilities than comparative copper-molybdenum contact materials. And further, even in comparison with many conventional copper-chromium contact materials, the contact materials of the present invention are superior in interrupting ability. Concerning samples 40 and 50 in Table 1, wherein tantalum occupies 70 volume % of the composition other than copper, experiments were made for cases wherein chromium and molybdenum are respectively present in 15 volume %. Though their interrupting abilities are not shown in the graph, examples having 60 volume %; i,e % copper (sample 40) and 75 volume % copper (sample 50) have respectively 4.1 times and 3.9 times as high interrupting ability as comparative copper-molybudenum contact material of sample 72. Accordingly, a component range of the contact materials having practical interrupting abilities is such that tantalum is 2.5–28 volume %, molybdenum is 1.25–34 volume % and chromium is 1.25–34 volume %.

Figure 7:
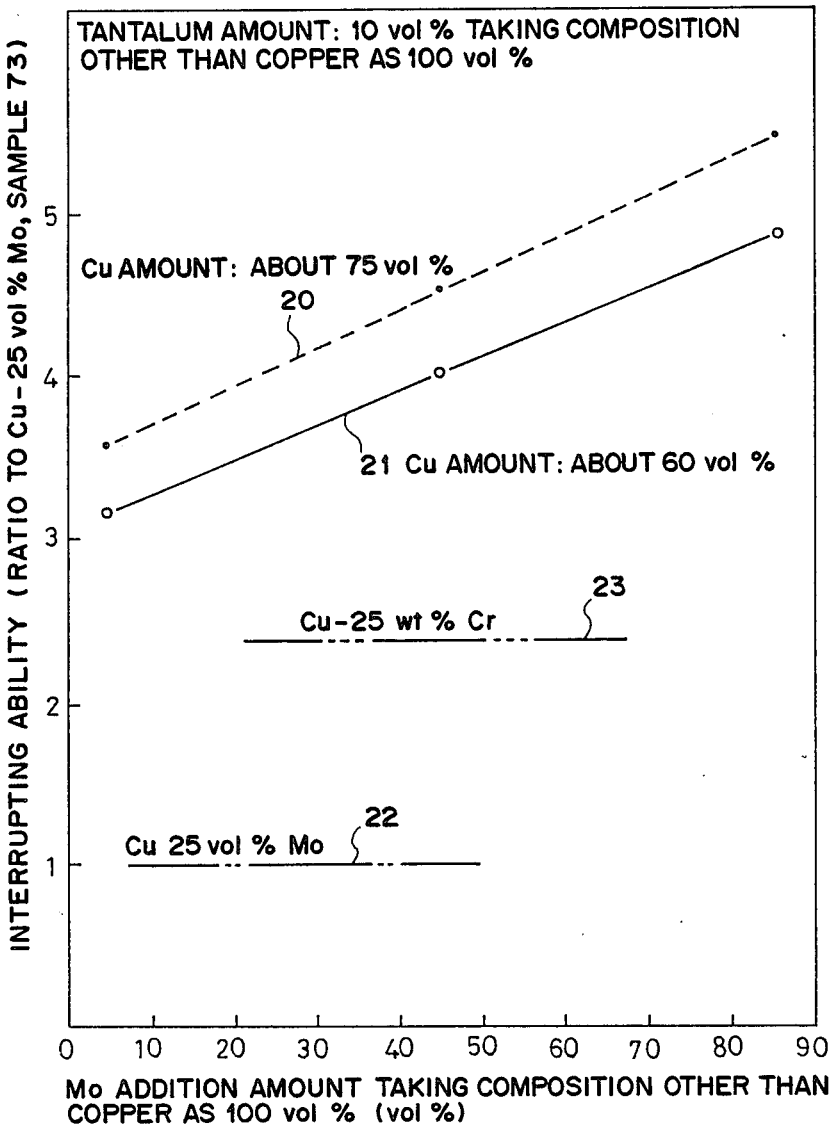
FIG. 7, FIG. 8 and FIG. 9 are graphs which show the interrupting abilities of copper-chromium-molybdenum-tantalum-contact materials manufactured by a hot press method as an embodiment of the present invention.
Figure 8:
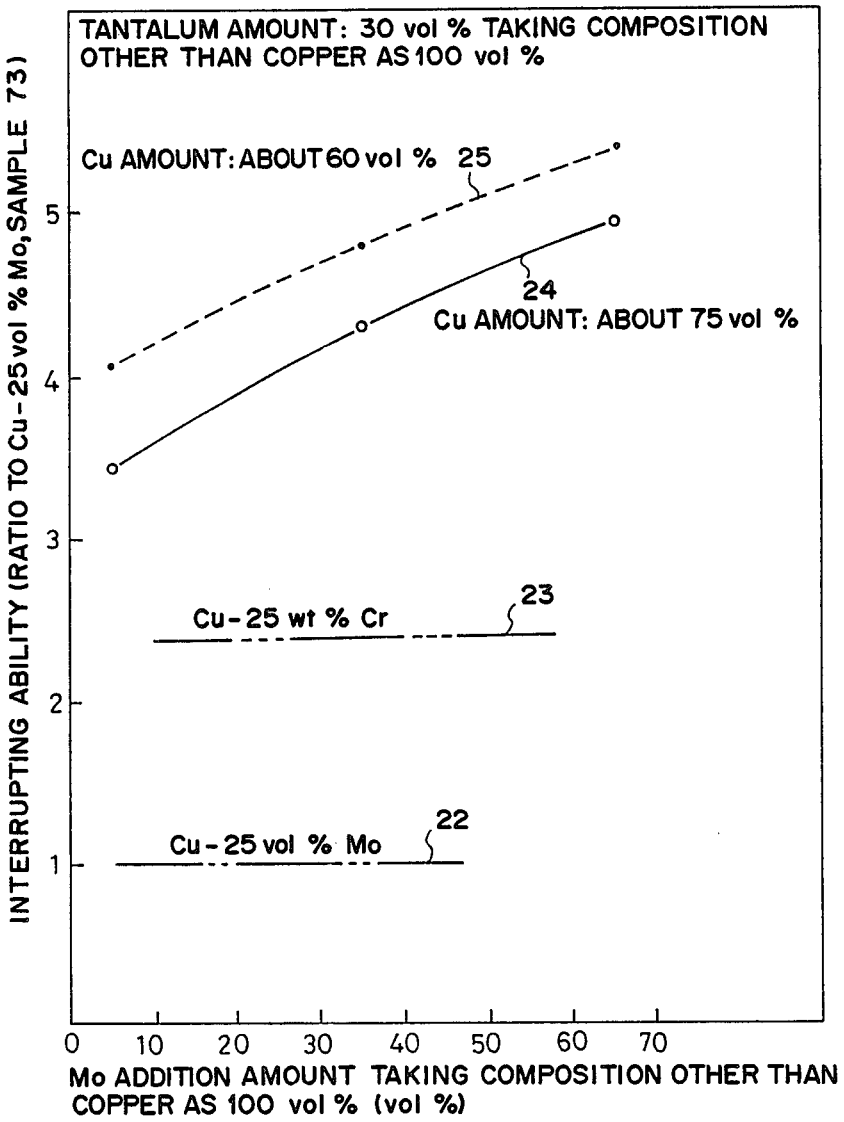
Figure 9:
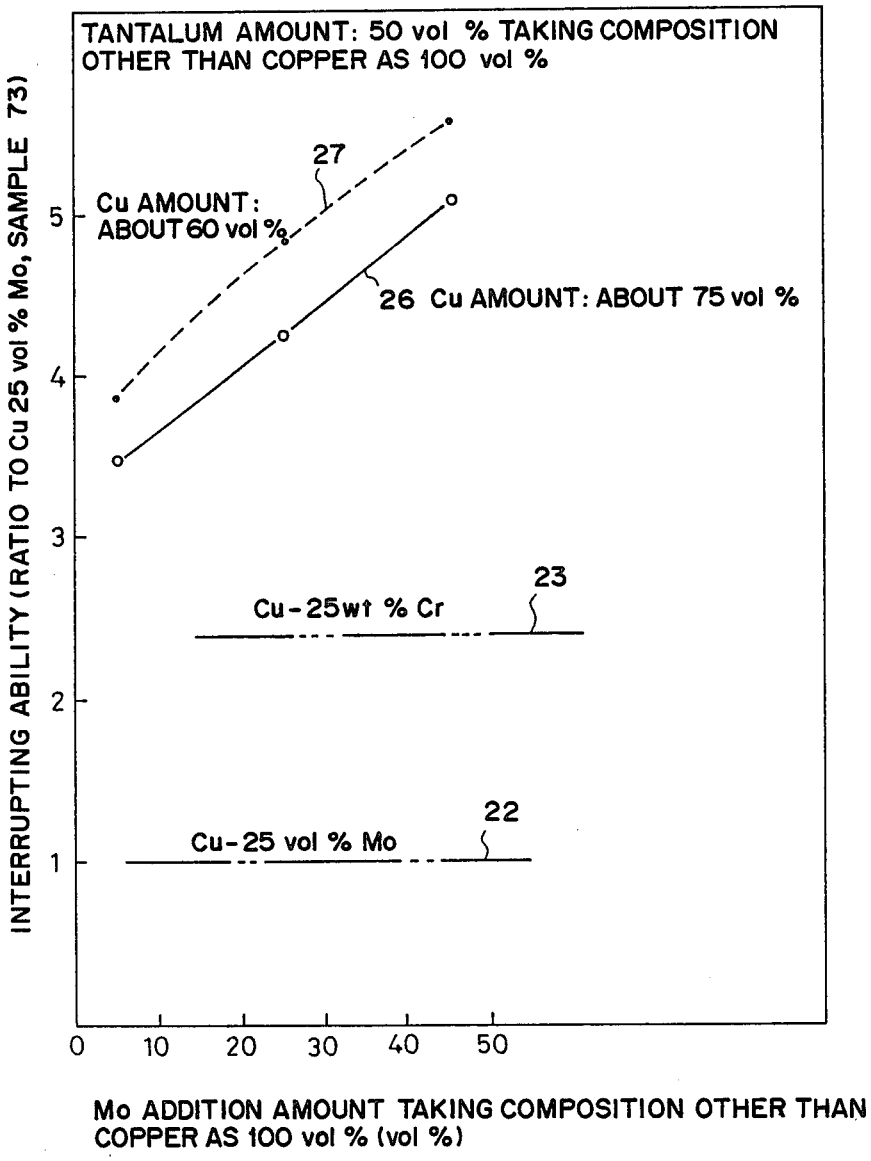

Next, the interrupting abilities of contact materials of the present invention obtained by hot-press method are shown in FIGS. 7, 8 and 9. Abscissas of FIGS. 7–9 show ratio of molybdenum in composition other than copper by volume % taking the composition excluding the copper as a reference (100 volume %), because the contact materials consist of four components. Ordinates of FIGS. 7–9 show the ratios of interrupting abilities of the contact materials, taking the interrupting ability of copper-25 volume % molybdenum comparative contact material of sample 73 obtained by hot-press method as 1. The curves are divided into FIG. 7, FIG. 8 and FIG. 9, depending on ratios of tantalum to compositions excluding copper. That is, FIG. 7 is for the contact materials in the present invention, wherein tantalum accounts for 10 volume % of composition other than copper. Curve (20) in FIG. 7 shows interrupting abilities of such contact materials of samples 61, 62 and 63 in the present invention, wherein tantalum occupies 10 volume % of the composition other than copper, the composition being about 25 volume % of contact material. Curve (21) in FIG. 7 shows interrupting abilities of contact materials, samples 51, 52 and 53, wherein tantalum occupies 10 volume % of the composition other than copper, the composition being about 40 volume % of contact material. And further, line (22) in FIG. 7 shows the interrupting ability of comparative copper molybdenum contact material of sample 73, and line (23) in FIG. 7 shows interrupting ability of conventional copper-chromium contact material of sample 74.

FIG. 8 similarly shows the interrupting abilities of contact materials in the present invention wherein copper amount accounts for about 75 and 60 volume % and tantalum occupies 30 volume % of the composition other than copper, the composition being 25 volume % and 40 volume % of contact material, respectively.

FIG. 9 similarly shows the interrupting abilities of contact materials, wherein copper amount accounts for about 75 and 60 volume %, and tantalum occupies 50 volume % of the composition other than copper, the composition being about 25 volume % and 40 volume % of contact material, respectively.

From FIG. 7, FIG. 8 and FIG. 9, it is obvious that the contact materials in the present invention have better interrupting abilities than comparative copper-molybdenum contact materials; and furthermore, in comparison with many widely used conventional copper-chromium contact materials, the contact materials in accordance with the present invention have superior interrupting abilities. Concerning samples 60 and 70, wherein experiments were made for cases wherein the chromium content and molybdenum amounts are respectively 15 volume %, though their interrupting abilities are not shown in the graphs, examples having 60 volume % copper (sample 60) and 75 volume % copper (sample 70) have, respectively, 4.2 times and 4.8 times higher interrupting abilities as comparative copper-molybdenum contact material (sample 73). Accordingly, the component range of the contact materials having practical interrupting abilities is that tantalum is 2.5–28 volume %, molybdenum is 1.25–34 volume % and chromium is 1.25–34 volume %.

Furthermore, from curve (1) in FIG. 1, curve (13) in FIG. 4 and curve (21) in FIG. 7, for contact materials in the present invention, wherein copper accounts for about 60 volume % and tantalum occupies 70 volume % of the composition other than copper, the composition being 40 volume % of contact materials, it is possible to compare differences of the interrupting abilities depending on manufacturing method. It is thus found that interrupting abilities do not differ much with the manufacturing method. From FIG. 2, FIG. 5 and FIG. 8, and FIG. 3, FIG. 6 and FIG. 9, concerning the contact materials, wherein copper occupies 60 volume %, it is similarly possible to compare the difference of interrupting abilities; and it is found that the ones made by the infiltration method are very good in interrupting ability compared to those by other two methods. However, even the contact materials obtained by the sintering method and the hot-press method have better interrupting ability than conventional copper-chromium contact material. Therefore, in spite of differences of the manufacturing methods, the contact materials of the present invention are technically advantageous in the range wherein tantalum amount is 2.5–42 volume %, molybdenum amount is 1.25–51 volume % and chromium is 1.25–51 volume %, regardless of manufacturing method, such as infiltraton method, sintering method or hot-press method.

Furthermore, taking notice of molybdenum and chromium amounts in contact materials, there is a tendency wherein contact ability becomes better as the molybdenum amount becomes larger than the chromium amount. Though the detailed reason for this contact ability becoming better is not obvious, one factor considered by the inventors to be relevant is that electric conductivity is lowered by formation of a solid solution of chromium in copper. This tendency is most noticeable in the case of the infiltration method, and therefore, in practical use of the contact material, it is desirable that the content of molybdenum be larger than chromium.

On the other hand, another electrical characteristic, breakdown voltage ability was also measured. The measurement is made by using a conditioning method, wherein AC voltage is applied gradually under the condition that a fixed gap exists between a pair of contacts. A judgement of breakdwon voltage ability is then made, by comparing a voltage such that discharge does not yet take place for a predetermined time with a reference voltage of conventional copper-chromium contact material. As a result, the breakdown voltage abilities of contact materials of the present invention are in a range 1.2–1.5 times as high as the conventional copper-chromium contact material. Moreover, from an experiment wherein making a current by connecting the contacts and breaking a current by opening the contacts are alternately repeated, a high voltage is applied to the opened contacts every time when the contacts are opened, and observations whether discharging across the contacts takes place or not are made, a rate of occurrence of the discharging is obtained by the following expression:

[number of occurrences of the discharging]/[number of breaking current and number of making current]

It is found that in the contact materials of the present invention, the probability of discharge was from as low as 1/5 to ⅓of that of the conventional copper-chromium contact material. Furthermore, it is found that the contact materials of the present invention have splendid breakdown voltage ability.

Making of Contact Material

The contact mterial are made by known powder metallurgy techniques, which include three kinds of methods, i.e., the infiltration method, sintering method and hot press method.

The first method of manufacturing contact material, the infiltration method, is as follows: Chromium powder of under 45 μm in particle diameter, molybdenum powder of 3 μm in average particle diameter, niobium powder of under 40 μm in particle diameter and copper powder of under 40 μm in particle diameter and copper powder of under 40 μm in particle diameter are weighed respectively in the ratio of 42.5:43.4:9.9:4.4, and thereafter are mixed for two hours. The mixed powder is then charged in a known metal die and pressed under a pressure of 1 ton/cm$^2$ to form a green compact.

Next, the green compact is fired for two hours in a vacuum at the temperature of 1000° C., thus a presintering green compact is obtained. Thereafter, a lump of oxygen free copper is put on the presintering green compact, and is kept for one hour under a hydrogen atmosphere at the temperature of 1250° C., and the contact material is obtained by infiltration of oxygen-free copper into the presintered green compact. Final ratios of components of the above-mentioned contact material is shown as sample 112 in Table 5. Further, contact materials other than the sample 112, which are made by the above-mentioned method and respectively have different ratios of components, are shown in Table 5. For samples 101–110 the target copper amount, which is an intended target value of copper when the contact material is fiinally completed, is 60 volume %. For samples 111–120, the target copper amount is 50 volume % and for samples 121–130 the target copper amount is 40 volume %.

| Sample | Component (vol %) | Electric conductivity (IACS %) | Remarks |
|---|---|---|---|
| 101 | Cu-40(Cr-5Mo-10Nb) | 55.5 | Target Cu |
| 102 | Cu-39(Cr-45Mo-10Nb) | 62.0 | amount: 60 vol % |
| 103 | Cu-41(Cr-85Mo-10Nb) | 70.3 | |
| 104 | Cu-42(Cr-5Mo-30Nb) | 57.1 | |
| 105 | Cu-39(Cr-35Mo-30Nb) | 62.1 | |
| 106 | Cu-40(Cr-65Mo-30Nb) | 71.3 | |
| 107 | Cu-40(Cr-5Mo-50Nb) | 60.1 | |
| 108 | Cu-41(Cr-25Mo-50Nb) | 66.8 | |
| 109 | Cu-39(Cr-45Mo-50Nb) | 70.0 | |
| 110 | Cu-40(Cr-15Mo-70Nb) | 71.9 | |
| 111 | Cu-51(Cr-5Mo-10Nb) | 41.8 | Target Cu |
| 112 | Cu-52(Cr-45Mo-10Nb) | 47.6 | amount: 50 vol % |
| 113 | Cu-50(Cr-85Mo-10Nb) | 61.2 | |
| 114 | Cu-51(Cr-5Mo-30Nb) | 47.7 | |
| 115 | Cu-49(Cr-35Mo-30Nb) | 55.1 | |
| 116 | Cu-53(Cr-65Mo-30Nb) | 60.3 | |
| 117 | Cu-50(Cr-5Mo-50Nb) | 49.0 | |
| 118 | Cu-51(Cr-25Mo-50Nb) | 54.5 | |
| 119 | Cu-49(Cr-45Mo-50Nb) | 61.1 | |

-continued

| Sample | Component (vol %) | Electric conductivity (IACS %) | Remarks |
|---|---|---|---|
| 120 | Cu-53(Cr-15Mo-70Nb) | 62.6 | |
| 121 | Cu-61(Cr-5Mo-10Nb) | 38.7 | Target Cu |
| 122 | Cu-62(Cr-45Mo-10Nb) | 43.3 | amount: 40 vol % |
| 123 | Cu-61(Cr-85Mo-10Nb) | 55.2 | |
| 124 | Cu-60(Cr-5Mo-30Nb) | 40.0 | |
| 125 | Cu-61(Cr-35Mo-30Nb) | 44.1 | |
| 126 | Cu-59(Cr-65Mo-30Nb) | 48.8 | |
| 127 | Cu-60(Cr-5Mo-50Nb) | 42.3 | |
| 128 | Cu-57(Cr-25Mo-50Nb) | 46.7 | |
| 129 | Cu-61(Cr-15Mo-50Nb) | 50.1 | |
| 130 | Cu-60(Cr-15Mo-70Nb) | 49.9 | |

The second method of manufacturing the contact material, i.e., the sintering method, is as follows. Chromium powder of under 75 μm in particle diameter, molybdenum powder of 3 μm in averag particle diameter, niobium powder of under 40 μm in particle diamter and copper powder of under 40 μm in particle diameter are weighed in the ratio of 14.9:18.9:3.9:62.3, and are mixed for two hours. Next, this mixed powder is chargd in a known metal die and pressed under pressure of 3.3 ton/cm$^2$ to form a green compact.

Then, this green compact is fired for two hours under a hydrogen atmosphere at a temperature of 1075°–1080° C. (under the melting point of copper). Thus, the contact material is obtained. This example is shown as sample 132 in Table 6. Furfther, contact materials other than sample 132 which are made by the above-mentioned method and respectively have different ratio of components, are shown in Table 6. In Table 6, for samples 131–140 the copper amount is 60 volume % and for samples 141–150 the copper amount is 75 volume %.

TABLE 6

(Complete powder sintering method)

| Sample | Component (vol %) | Electric conductivity (IACS %) |
|---|---|---|
| 131 | Cu-40(Cr-5Mo-10Nb) | 41.0 |
| 132 | Cu-40(Cr-45Mo-10Nb) | 45.1 |
| 133 | Cu-40(Cr-85Mo-10Nb) | 54.8 |
| 134 | Cu-40(Cr-5Mo-30Nb) | 44.2 |
| 135 | Cu-40(Cr-35Mo-30Nb) | 51.3 |
| 136 | Cu-40(Cr-65Mo-30Nb) | 61.5 |
| 137 | Cu-40(Cr-5Mo-50Nb) | 41.7 |
| 138 | Cu-40(Cr-25Mo-50Nb) | 49.9 |
| 139 | Cu-40(Cr-45Mo-50Nb) | 58.7 |
| 140 | Cu-40(Cr-15Mo-70Nb) | 56.4 |
| 141 | Cu-25(Cr-5Mo-10Nb) | 45.3 |
| 142 | Cu-25(Cr-45Mo-10Nb) | 58.9 |
| 143 | Cu-25(Cr-85Mo-10Nb) | 70.1 |
| 144 | Cu-25(Cr-5Mo-30Nb) | 48.2 |
| 145 | Cu-25(Cr-35Mo-30Nb) | 57.7 |
| 146 | Cu-25(Cr-65Mo-30Nb) | 61.0 |
| 147 | Cu-25(Cr-5Mo-50Nb) | 51.3 |
| 148 | Cu-25(Cr-25Mo-50Nb) | 60.0 |
| 149 | Cu-25(Cr-45Mo-50Nb) | 68.9 |
| 150 | Cu-25(Cr-15Mo-70Nb) | 69.3 |

The third method of manufacturing contact material, i.e., the hot-press method, is the same as the above-mentioned sintering method with respect to mixing a metal powder, and the mixed powder which is the same as in above-mentioned example is used. The mixed powder is charged in a carbon die, and while it is heated for two hours in vacuum, a pressure of 200 kg/cm$^2$ is applied thereon and a block of the contact material is obtained. This example is shown as sample in Table 7. Further, the contact materials other than sample 52 which are manufactured by the above-mentioned method and are respectively have different ratio of components are shown in Table 7. In Table 7, for samples 151–160 the copper amount is 40 volume %, and for samples 161–170 copper amount is 75 volume %.

TABLE 7

(Hot-press method)

| Sample | Component (vol %) | Electric conductivity (IACS %) |
|---|---|---|
| 151 | Cu-40(Cr-5Mo-10Nb) | 47.5 |
| 152 | Cu-40(Cr-45Mo-10Nb) | 50.0 |
| 153 | Cu-40(Cr-85Mo-10Nb) | 62.0 |
| 154 | Cu-40(Cr-5Mo-30Nb) | 48.3 |
| 155 | Cu-40(Cr-35Mo-30Nb) | 52.2 |
| 156 | Cu-40(Cr-65Mo-30Nb) | 68.1 |
| 157 | Cu-40(Cr-5Mo-50Nb) | 49.9 |
| 158 | Cu-40(Cr-25Mo-50Nb) | 53.1 |
| 159 | Cu-40(Cr-45Mo-50Nb) | 64.5 |
| 160 | Cu-40(Cr-15Mo-70Nb) | 65.0 |
| 161 | Cu-25(Cr-5Mo-10Nb) | 61.0 |
| 162 | Cu-25(Cr-45Mo-10Nb) | 64.3 |
| 163 | Cu-25(Cr-85Mo-10Nb) | 74.3 |
| 164 | Cu-25(Cr-5Mo-30Nb) | 58.7 |
| 165 | Cu-25(Cr-35Mo-30Nb) | 64.3 |
| 166 | Cu-25(Cr-65Mo-30Nb) | 72.8 |
| 167 | Cu-25(Cr-5Mo-50Nb) | 59.0 |
| 168 | Cu-25(Cr-25Mo-50Nb) | 63.5 |
| 169 | Cu-25(Cr-45Mo-50Nb) | 70.1 |
| 170 | Cu-25(Cr-15Mo-70Nb) | 69.7 |

Further, conventional contact materials are shown as comparative samples in above-mentioned Table 4.

Characteristics of Contact Materials and Experiments

Contact materials manufactured the above-mentioned methods are machine-worked into electrodes of diameter 20 mm, and thereafter, the electric conductivity of each is measured. A metal conductivity measurement apparatus (Institut br, Föster GmbH Co. Kg SIGMA TEST 2067) is used for measurement of conductivity, and measured data are shown in Table 5, 6 and 7. Conventional contact materials are shown in Table 4. From the above-mentioned data, it is found that contact materials in the present invention are equal to, or better than the conventional copper-chromium contact material of sample 74.

Figure 10:
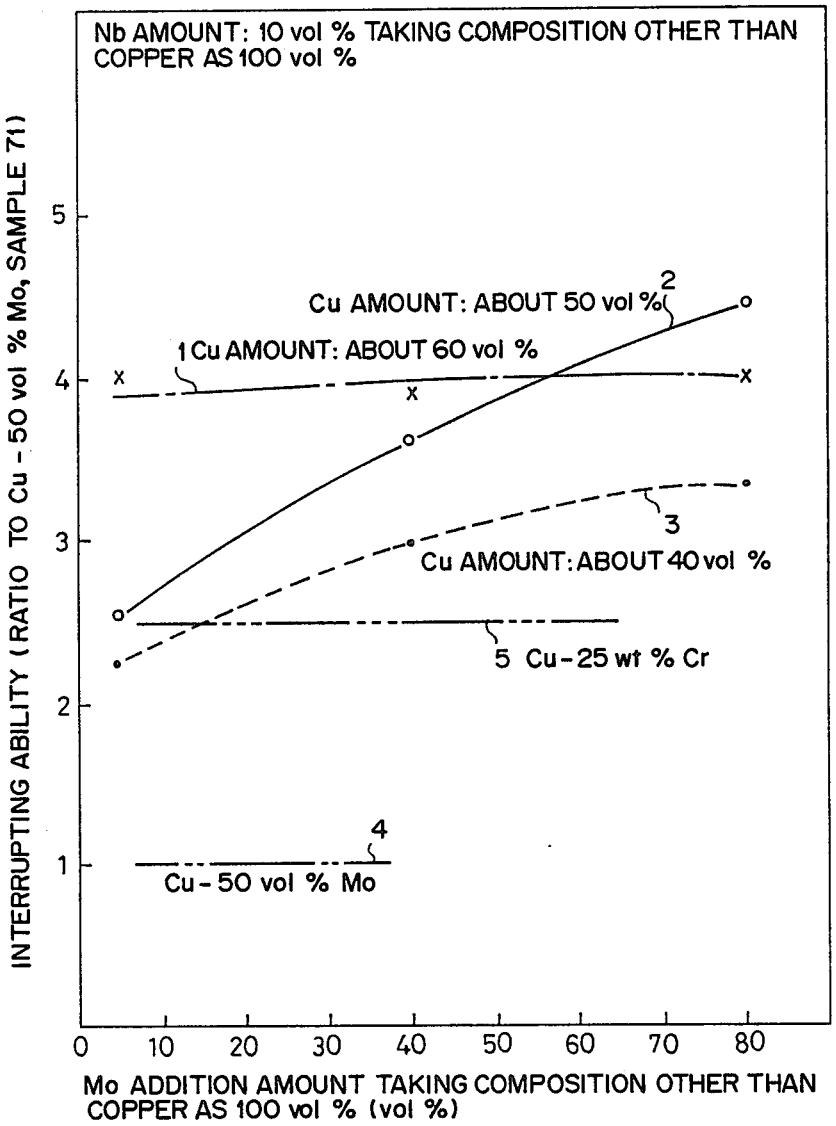
FIG. 10, FIG. 11 and FIG. 12 are graphs which show the interrupting abilities of copper-chromium-molybdenum-niobium-contact materials manufactured by an infiltration method as embodiments of the present invention.
Figure 11:
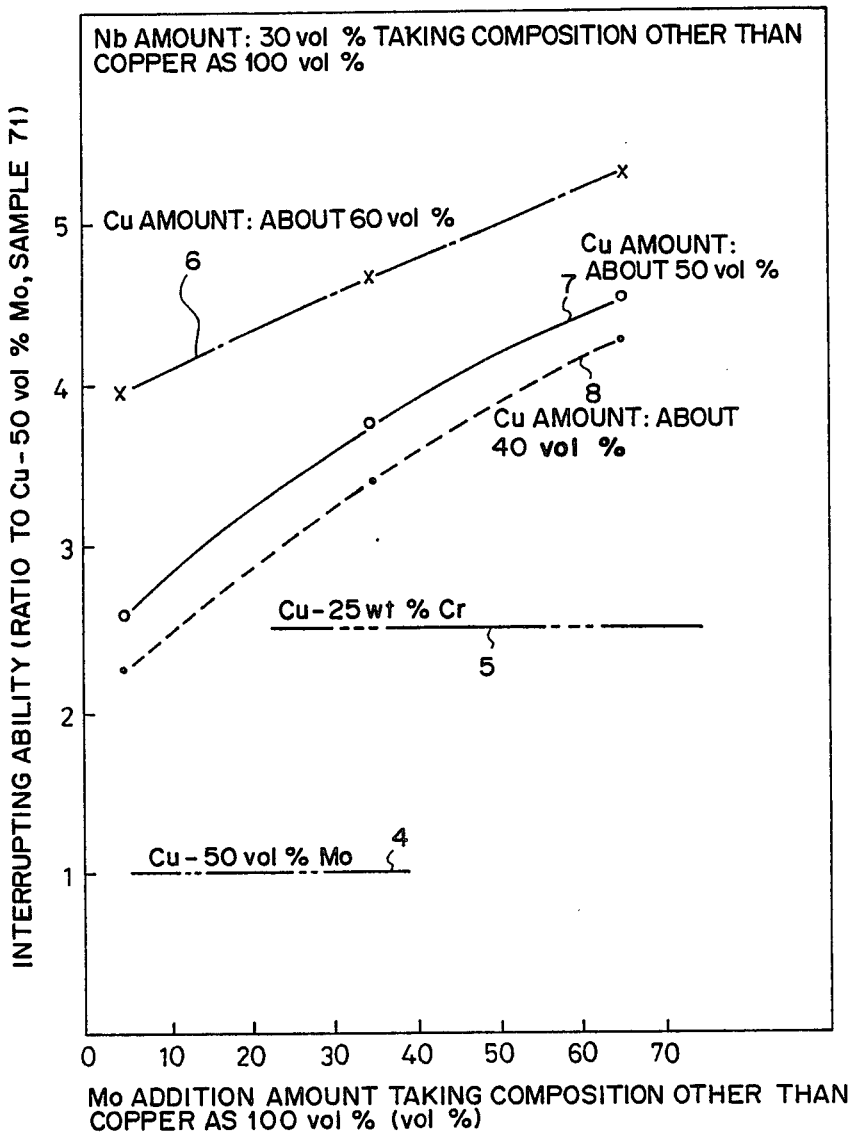
Figure 12:
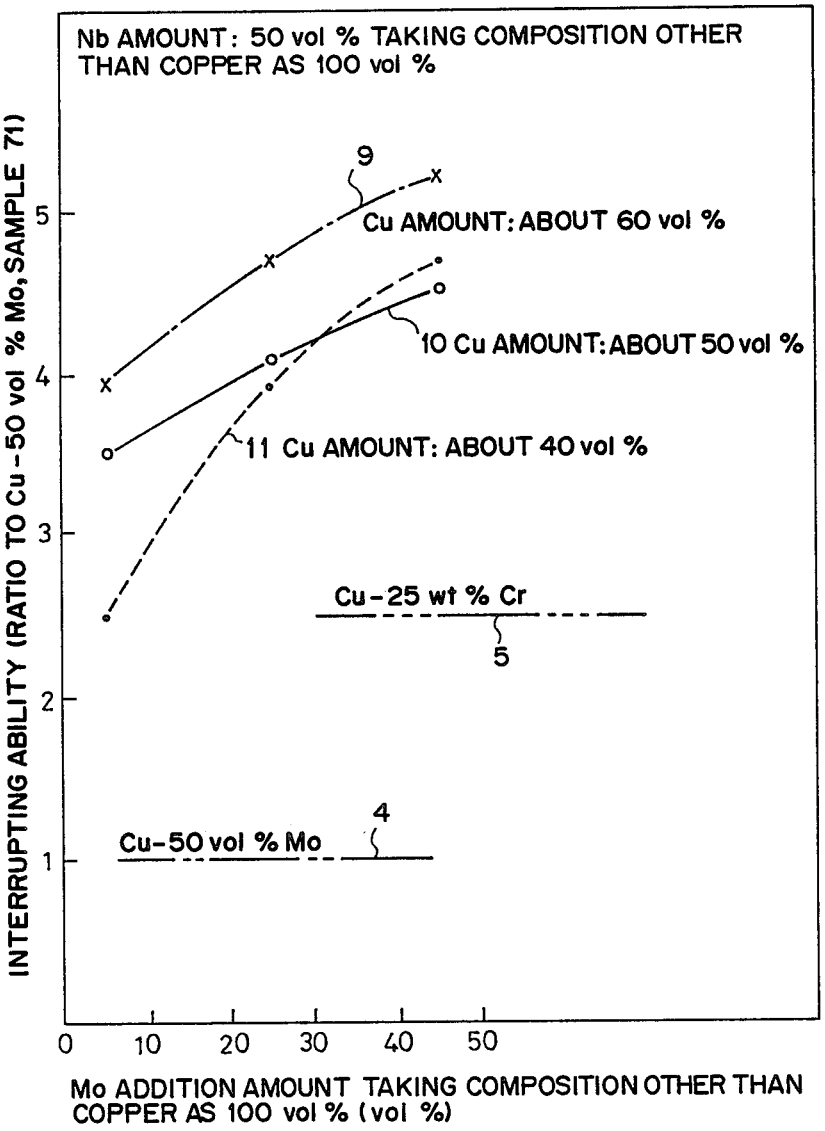

Next, a vacuum interrupter is assembled by using the electrodes thus made and their electrical characteristics are measured. FIG. 10, FIG. 11 and FIG. 12 show interrupting abilities of various contact materials of the present invention, by taking the interrupting ability of sample 71 (comparative sample) as 1. Since the contact materials in the present invention consist of four components, abscissas of FIGS. 10–12 show the component ratio of the molybdenum in the composition other than copper by volume %, taking the composition excluding copper as reference (100 volume %).

Ordinates of FIGS. 10–12 show ratios of interrupting abilities of contact materials of the present invention taking the interrupting ability of copper—50 volume % molybdenum comparative contact material (sample 71) as 1. The curves are divided into FIGS. 11–12 depending on proportions of niobium to compositions excluding copper. That is, FIG. 10 is for the contact materials of the present invention wherein niobium accounts for 10 volume % of composition excluding copper. Curve (1) in FIG. 10 shows the interrupting abilities of contact materials of samples 101–103 in Table 5 of the present invention and niobium occupies 10 volume % of the composition other than copper, the composition being about 40 volume % of the contact material.

Curve (2) in FIG. 10 shows the interrupting abilities of such contact materials as samples 111–113 of the present invention in Table 1, in which copper accounts for 50 volume %, and niobium occupies 10 volume % of the compositions, being about 50 volume % of contact material, furthermore, molybdenum addition amount is changd respectively. Curve (3) in FIG. 10 shows the interrupting abilities of the contact materials of samples 121, 122 and 123 of the present invention in Table 5, wherein copper accounts for 40 volume % and niobium occupies 10 volume % of the composition other than copper, the composition being 60 volume % of the contact material, and the molybdenum amount is respectively changed. Then line (4) in FIG. 10 shows the interrupting ability of copper-molybdenum contact material of sample 71, for reference. Line (5) in FIG. 10 shows the interrupting ability of the conventional copper-chromium contact material of sample 74.

FIG. 11 similarly shows the interrupting ability of the contact materials of the present invention, wherein copper accounts for about 40, 50 and 60 volume %, and niobium occupies 30 volume % of the composition other than copper.

Further, FIG. 12 similarly shows the interrupting abilitty f contact materials wherein niobium accounts for 50 volume % of composition other than copper.

From FIGS. 10–12, it is found that the contact materials of the present invention have better interrupting abilities than comparative copper-molybdenum contact materials. Furthermore, in comparison with widely conventional copper-chromium contact materials, the contact materials of the present invention are superior in interrupting abilities over the whole range.

Further, concerning samples 110, 120 and 130 wherein niobium occupies 70 volume % of composition other than copper, experiments are made for cases wherein chromium and molybdenum are respectively 15 volume %. Though their interrupting abilities are not shown in the graphs, examples having 60 volume % copper (sample 110), 50 volume % copper (sample 120) and 40 volume % copper (sample 130) have, respectively, 4.7 times, 4.2 times and 3.5 times as higher interrupting ability as the comparative copper-molybdenum contact material of sample 71. Accordingly, a component range of the contact materials having practical interrupting abilities is that niobium is from 4 volume % (samples 101, 102 and 103, curves in FIG. 10) to 42 volume % (sample 130), molybdenum is from 2 volume % (sample 101) to 51 volume % (sample 123), and chromium is from 2 volume % (sample 106) to 51 volume % (sample 121).

Figure 13:
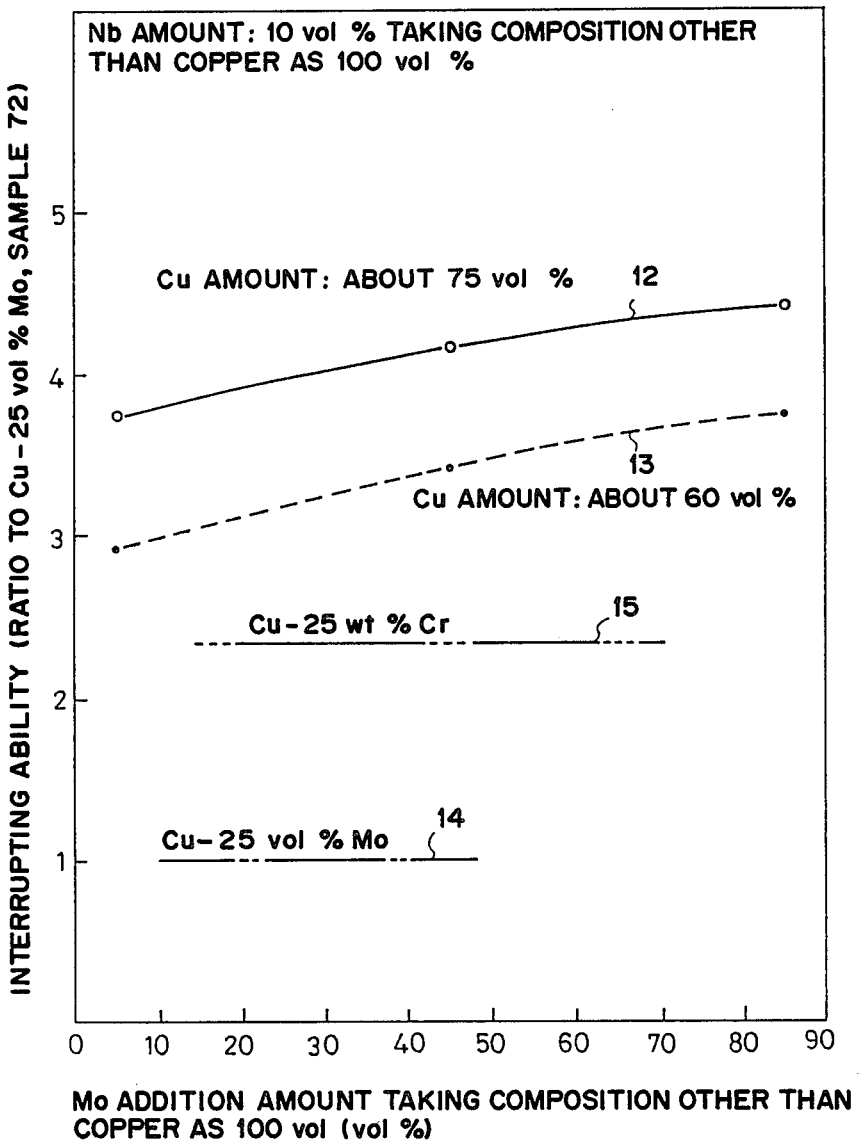
FIG. 13, FIG. 14 and FIG. 15 are graphs which show the interrupting abilities of copper-chromium-molybdenum-niobium-contact materials manufactured by a sintering method as an embodiment of the present invention.
Figure 14:
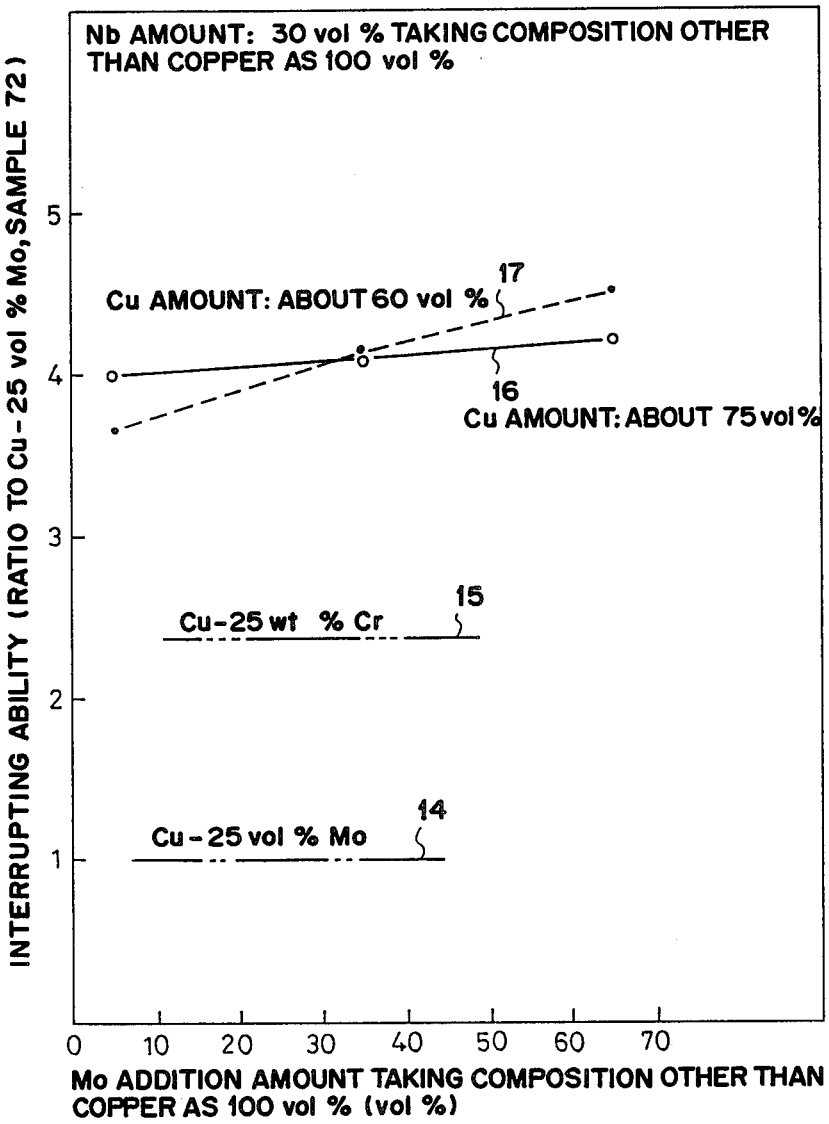
Figure 15:
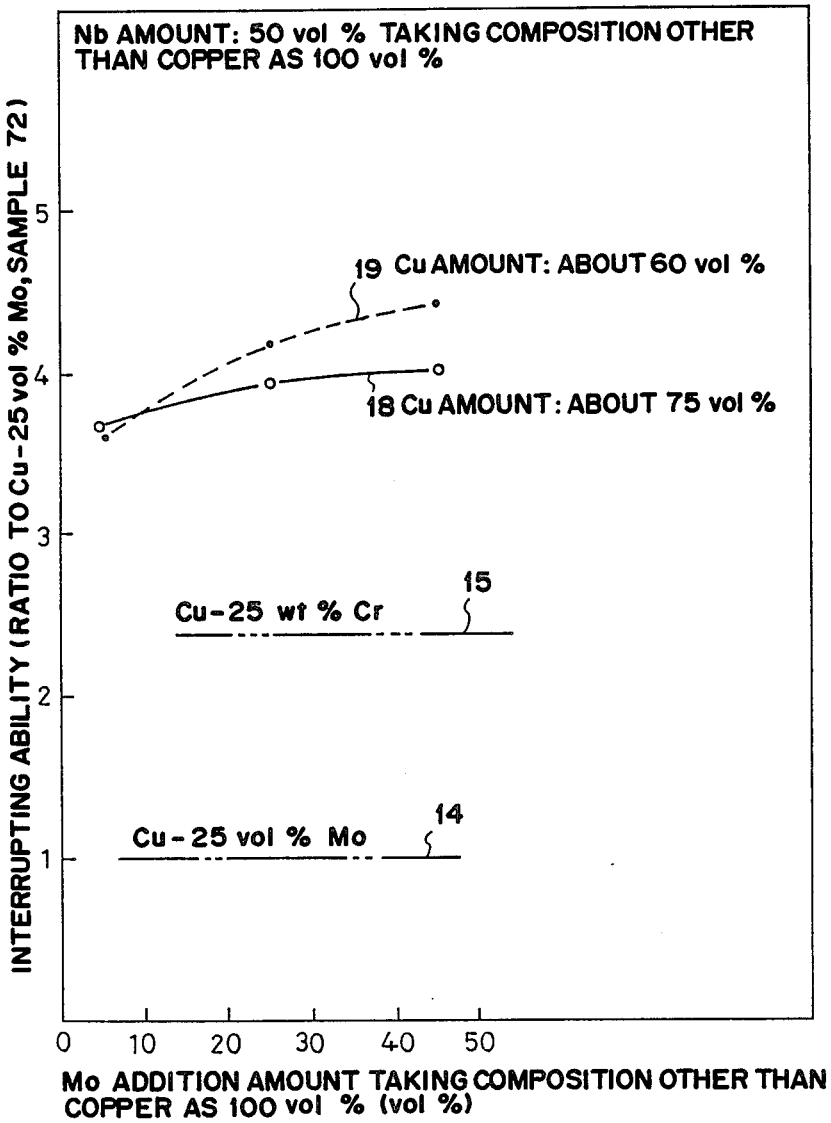

Next, the interrupting abilities in the present invention obtained by sintering method are shown in FIGS. 13, 14 and 15. Since the contact materials consist of four components, abscissas of FIGS. 13–15 show component ratio of molybdenum in composition other than copper by volume % taking the composition other than copper as a reference (100 volume %). The ordinates of FIGS. 13–15 show ratio of interrupting abilities to comparative copper—25 volume % molybdenum contact material (sample 72) obtained by sintering method taking the interrupting ability thereof as 1.

The curves are shown divided into FIGS. 13–15, depending on the ratio of niobium to compositions other than copper. That is, FIG. 13 is for the contact materials in the present invention wherein niobium accounts for 10 volume % of composition other than copper, curve (12) in FIG. 13 shows interrupting abilities of the contact materials of samples 141, 142 and 143, wherein copper accounts for 75 volume %, and niobium occupies 10 volume % of composition other than copper, the composition being 25 volume % of contact material. Curve (13) in FIG. 13 shows the interrupting abilities of contact materials of sample 131, 132 and 133,wherein copper accounts for about 60 volume %, and niobium occupies 10 volume % of composition other than copper, the composition being 40 volume % of contact material. Further, line (14) in FIG. 13 shows the interrupting abilities of copper-molybdenum contact material of sample 72 for reference, and line (15) in FIG. 13 shows the interrupting ability of conventional copper-chromium contact material of sample 74.

FIG. 14 similarly shows the interrupting abilities of the contact materials in the present invention, wherein copper accounts for about 75 volume % and about 60 volume %, and niobium occupies 30 volume % of the composition other than copper, the composition being about 25 and 40 volume % of contact material.

FIG. 15 similarly shows the interrupting abilities of contact materials wherein niobium occupies 50 volume % of composition other than copper.

From FIGS. 13, 14 and 15, it is seen that the contact materials of the present invention have better interrupting abilities than comparative copper-molybudenum contact material. Further, even in comparison with the widely used conventional copper-chromium contact material, the contact materials of the present invention are better in interrupting ability. Moreover, concerning sample 140 and 150 wherein niobium occupies 70 volume % of the composition other than copper, experiments are made for cases wherein chromium and molybudenum amount are respectively 15 volume %. Their interrupting abilities are not shown in the graph, but examples having copper 60 volume % (sample 140) and copper 75 volume % (sample 150) have, respectively, 4.1 times and 3.9 times as high interrupting ability as the comparative copper-molybudenum contact material (sample 72). Accordingly, the component range of the contact materials having practical interrupting abilities, niobium is from 2.5 volume % (samples 141, 142 and 143) to 28 volume % (sample 140), molybudenum is from 1.25 volume % (samples 141, 144 and 147) to 34 volume % (sample 133), and chromium is from 1.25 volume % to 34 volume %.

Figure 16:
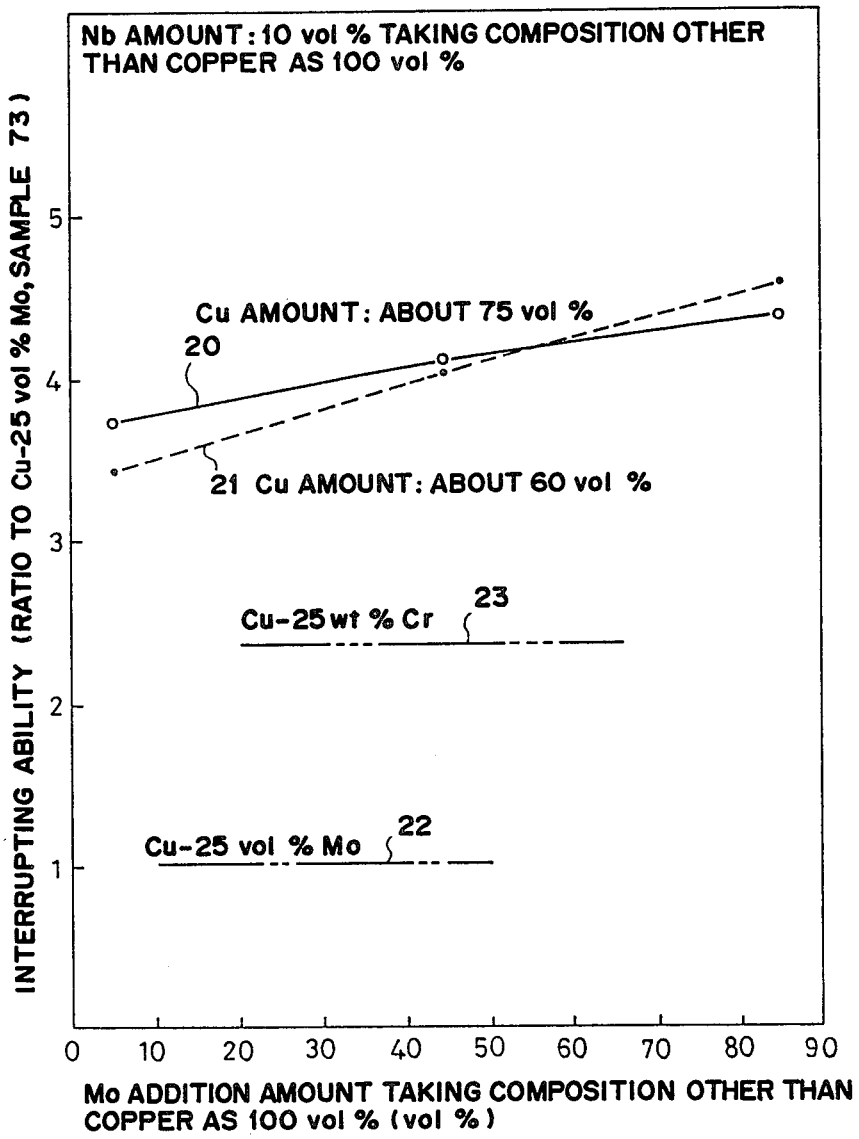
FIG. 16, FIG. 17 and FIG. 18 are graphs which show the interrupting abilities of copper-chromium-molybdenum-niobium-contact materials manufactured by a hot press method as an embodiment of the present invention.
Figure 17:
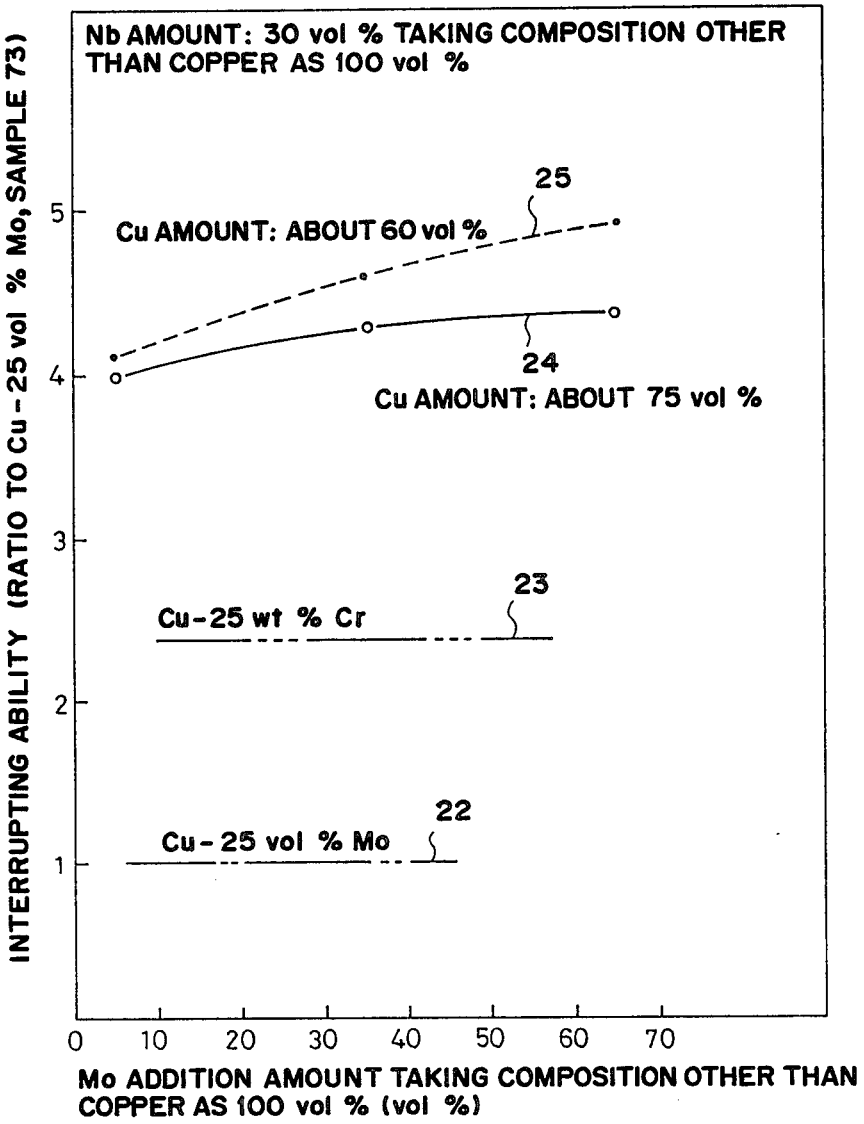
Figure 18:
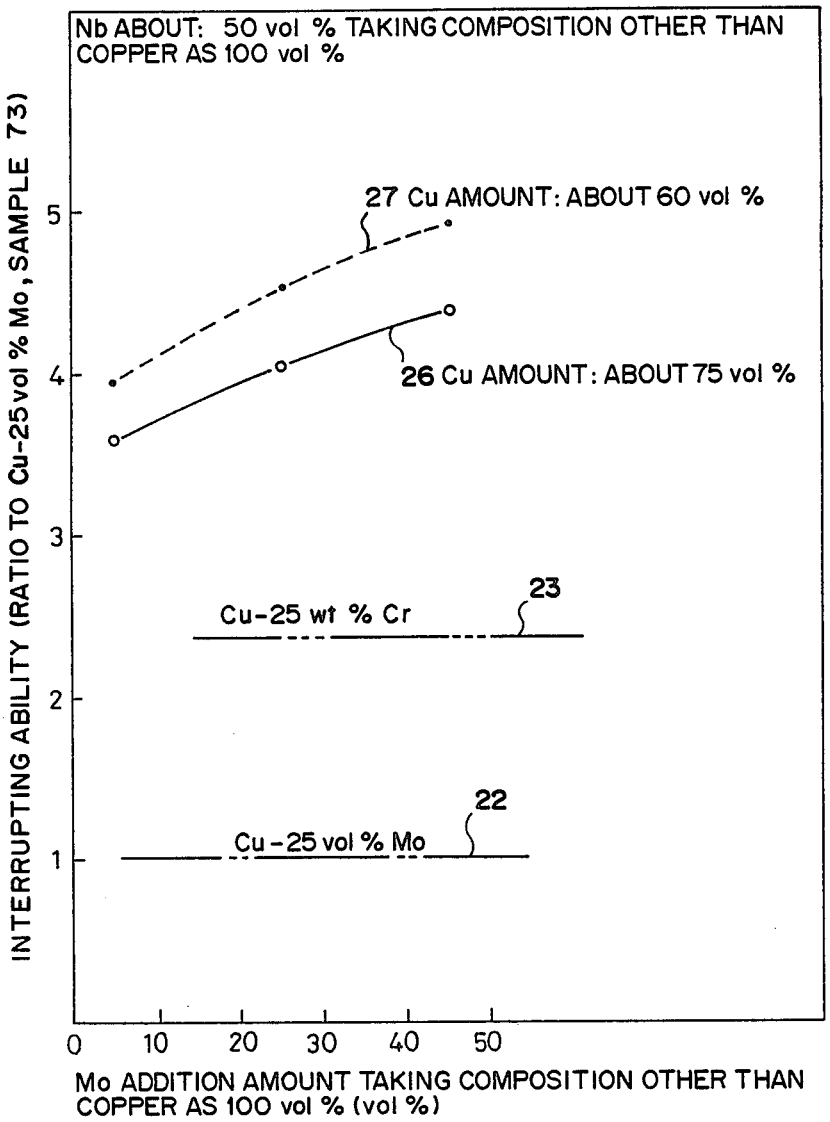

The interrupting abilities of contact materials of the present invention obtained by the hot-press method are shown in FIGS. 16, 17 and 18. Abscissas of FIGS. 16–18 show ratio of molybdenum in composition other than copper by volume % taking the composition excluding the copper as a reference (100 volume %), because the contact material consist of four components. Ordinates of FIGS. 16–18 show the ratio of interrupting abilities of the contact materials taking the interrupting ability of the copper—25 volume % molybdenum comparative contact material obtained by hot-press method as 1. The curves are shown divided into FIGS. 16–18 depending on ratios of niobium to composition other than copper. That is, FIG. 16 is for contact material of the present invention, wherein niobium accounts for 10 wt % of composition other than copper. Curve (20) in FIG. 16 shows, interrupting ability of the contact materials of samples 161, 162 and 163 of the present invention, wherein copper amount accounts for about 75 volume %, and niobium occupies for 10% of the composition other than copper, the composition being about 25 volume % of the contact material. Curve (21) in FIG. 7 shows the interrupting ability of contact material samples 151, 152 and 153, wherein copper amount accounts for about 60 volume %, and niobium occupies 10 volume % of the composition other than copper, the composition being 40 volume % of contact material. Line (22) in FIG. 16 shows the interrupting ability of copper-molybdenum contact material of sample 73 for reference, and line (23) in FIG. 16 shows the interrupting ability of the conventional copper-chromium contact material of sample 74.

FIG. 17 similarly shows the interrupting abilities of contact materials in the present invention, wherein copper amount accounts for about 75 and 60 volume %, and niobium accounts for 30 volume % of the composition other than copper, the composition being 25 and 40 volume % of contact material, respectively.

FIG. 18 similarly shows the interrupting abilities of contact materials wherein niobium accounts for 50 volume % of composition other than copper.

From FIGS. 16–18, it is obvious that the contact materials of the present invention have better interrupting ability than comparative copper-molybdenum contact material, further, even in comparison with widely conventional copper-chromium contact material, the contact materials in the present invention have superior interrupting ability. Furthermore, concerning sample 160 and 170, wherein niobium accounts for 70 volume % of the composition other than copper, experiments were made for cases wherein chromium and molybdenum amount are respectively 15 volume %. Though their interrupting abilities are not shown in the graphs, examples having 60 volume % copper (sample 160) and 75 volume % copper (sample 170) have, respectively, 4.1 times and 4.7 times as high interrupting ability as comparative copper-molybdenum contact material (sample 73). Accordingly, in a component range of the contact materials having practical interrupting ability, niobium is from 1.5 volume % (samples 161, 162 and 163) to 28 volume % (sample 160), molybdenum is from 1.25 volume % (samples 161, 164 and 167) to 34 volume % (sample 153), and chromium is from 1.25 volume % (sample 163, 166 and 169) to 34 volume % (sample 151).

Further, from curve (1) in FIG. 10, curve (13) in FIG. 13 and curve (21) in FIG. 16, for contact material in the present invention, wherein copper accounts for 60 volume % and niobium occupies 10 volume % of the composition other than copper, the composition being 40 volume % of contact material, it is possible to compare the interrupting abilities which are different from each other depending on manufacturing method. It is thus found that the infiltration method has better interrupting ability than the other two methods. However, even the contact materials obtained by the sintering method and the hot-press method are better in the interrupting ability than the conventional copper-chromium contact material. Therefore, in spite of differences in the manufacturing methods, the contact materials of the present invention are technically advantageous in the range wherein niobium amount is 2.5–42 volume %, molybdenum amount is 1.25–51 volume %, and chromium amount is 1.25–51 volume %, regardless of the manufacturing methods employed, e.g., the infiltration method, sintering method or hot-press method.

Furthermore, taking notice of the molybdenum and chromium amounts in the contact materials, there is a tendency that when the molybdenum amount becomes larger than the chromium amount, the contact ability becomes better. Though the detailed reasons thereof are not fully understood, one reason considered by the inventors is that electric conductivity is lowered by solid solution of chromium into copper. This tendecy is remarkable in the case of the infiltration method, and therefore, in practical use of the contact material it is desirable that the content of molybdenum is larger than chromium. Interruption of currents of 7.2 KV and 12.5 KA is realized by sample 112.

On the other hand, for other electrical characteristics, breakdown voltage ability is measured. The measurement is made by a conditioning method wherein AC voltage is applied gradually with the gap between a pair of contacts fixed constant. The, judgment of breakdown voltage ability is made by comparing the voltage such that discharge does not take place for a predetermined time with a reference voltage of case of the conventional copper-chromium contact material. As a result, the breakdown voltage abilities of contact materials of the present invention are in a range of 1.2–1.5 times as high as conventional copper-chromium contact material.

Moreover, from an experiment wherein making a current by connecting the contacts and breaking a current by opening the contacts are alternately repeated, a high voltage is applied to the opened contacts every time when the contacts are opened, and observations are made of whether discharging across the contacts takes place or not, a rate of occurrence of the discharging is obtained by the following expression:

[number of occurrences of the discharging]/[number of occurrences of breaking current and number of occurrences of making current]

It is found that of the contact material in the present invention, the probability of discharge was from as low as 1/5 to ⅓ of that of the conventional copper-chromium contact material. It is found that the contact materials of the present invention have excellent breakdown voltage ability.

As mentioned above, according to the present invention, a vacuum interrupter having excellent in interrupting ability and breakdown voltage ability is obtainable and the same is claimed in the claims hereof.

What is claimed is:

1. An electrode contact material, for a vacuum interrupter comprising a pair of opposing electrodes disposed operably to repeatedly contact and separate from each other in a vacuum container, comprising:

copper (Cu), chromium (Cr), molybdenum (Mo) and one member selected from a group consisting of tantalum (Ta) and niobium (Nb), wherein said contact material comprises approximately 1.25–51 volume % of chromium (Cr), approximately 1.25–51 volume % of molybdenum (Mo) and approximately 2.5–42 volume % of one of niobium (Nb) and tantalum (Ta), the rest of the contact material being copper (Cu).

2. A contact material for the vacuum interrupter in accordance with claim 1, wherein:

said contact material comprises approximately 2–51 volume % of chromium (Cr), approximately 2–51 volume % of molybdenum (Mo) and approximately 4–42 volume % of tantalum (Ta), the rest of the contact material being copper (Cu), and said contact is formed by a known infiltration process applied to said contact material.

3. A contact material for the vacuum interrupter in accordance wih claim 1, wherein:

said contact material comprises approximately 1.25–34 volume % of chromium (Cr), approximately 1.25–34 volume % of molybdenum (Mo) and approximately 2.5–28 volume % of tantalum (Ta), the rest of the contact material being copper (Cu), and said contact is formed by sintering of said contact material.

4. A contact material for the vacuum interrupter in accordance with claim 1, wherein:

said contact material comprises approximately 1.25–34 volume % of chromium (Cr), approximately 1.25–34 volume % of molybdenum (Mo) and approximately 2.5–28 volume % of tantalum (Ta), the rest of the contact material being copper (Cu), and said contact is formed by hot-pressing of said contact material.

5. A contact material for the vacuum interrupter in accordance with claim 1, wherein:

said contact material com prises approximately 1.25–51 volume % of chromium (Cr), approximately 1.25∝51 volume % of molybdenum (Mo) and approximately 2.5–42 volume % of niobium (Nb), the rest of the contact material being copper (Cu).

6. A contact material for the vacuum interrupter in accordance with claim 5, wherein:

said contact material comprises approximately 2–51 volume % of chromium (Cr), approximately 2–51 volume % of molybdenum (Mo), approximately 4–42 volume % of niobium (Nb), the rest of the contact material being copper (Cu), and said contact is formed by a known infiltration process applied to said contact material.

7. A contact material for the vacuum interrupter in accordance with claim 5, wherein:

said contact material comprises approximately 1.25–34 volume % of chromium (Cr), approximately 1.25–34 volume % of molybdenum and approximately 2.5–28 volume % of niobium (Nb), the rest of the contact material being copper (Cu), and said contact is formed by sintering of said contact material.

8. A contact material for the vacuum interrupter in accordance with claim 5, wherein:

said contact material comprises approximately 1.25–34 volume % of chromium (Cr), approximately 1.25–34 volume % of molybdenum (Mo) and approximately 2.5–28 volume % of niobium (Nb), the rest of the contact material being copper (Cu), and said contact is formed by hot-pressing of said contact material.

* * * * *